US008633412B2

(12) United States Patent
Mori et al.

(10) Patent No.: US 8,633,412 B2
(45) Date of Patent: Jan. 21, 2014

(54) SWITCH DEVICE AND METHOD OF ASSEMBLING SNAP ACTION MECHANISM

(75) Inventors: Toshiharu Mori, Miyagi-Ken (JP); Osamu Haga, Miyagi-Ken (JP); Syuji Fujiwara, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 303 days.

(21) Appl. No.: 13/040,169

(22) Filed: Mar. 3, 2011

(65) Prior Publication Data

US 2011/0147186 A1 Jun. 23, 2011

Related U.S. Application Data

(63) Continuation of application No. PCT/JP2009/066345, filed on Sep. 18, 2009.

(30) Foreign Application Priority Data

Sep. 22, 2008 (JP) ..... 2008-243271
Aug. 4, 2009 (JP) ..... 2009-181519

(51) Int. Cl.
*H01H 3/48* (2006.01)

(52) U.S. Cl.
USPC ..... 200/469; 200/462

(58) Field of Classification Search
USPC ..... 200/462–469, 405, 460, 452
See application file for complete search history.

(56) References Cited

U.S. PATENT DOCUMENTS 2,700,079 A † 1/1955 Haydon
2,905,780 A † 9/1959 Cherry, Jr.
3,073,923 A * 1/1963 Anderson et al. ..... 200/467
3,571,541 A * 3/1971 Bedocs et al. ..... 200/462
3,602,980 A † 9/1971 Heffner
3,996,435 A 12/1976 King
4,011,419 A † 3/1977 Anderson
4,230,919 A † 10/1980 Schantz
4,253,001 A † 2/1981 Momozhane
4,371,767 A † 2/1983 Ohashi
4,636,597 A 1/1987 Menche
4,673,778 A † 6/1987 Lewandowski (Continued)

FOREIGN PATENT DOCUMENTS

DE 4037157 5/1992
EP 1182673 2/2002

(Continued)

OTHER PUBLICATIONS

Search Report dated Dec. 22, 2009 from International Application No. PCT/JP2009/066345.

(Continued)

*Primary Examiner* — Renee Luebke
*Assistant Examiner* — Lheiren Mae Caroc
(74) *Attorney, Agent, or Firm* — Beyer Law Group LLP

(57) ABSTRACT

A switch device includes a housing having a receiving portion; an operation member that receives a pressing operation; a plurality of fixed contact points provided in the receiving portion side by side at predetermined intervals; a plurality of movable contact points having contact point portions that come into sliding contact with the fixed contact points; and a snap action mechanism that drives the movable contact points when the operation member is pressed to a predetermined position.

20 Claims, 28 Drawing Sheets

(56) References Cited

U.S. PATENT DOCUMENTS

| | | | | |
|---|---|---|---|---|
| 6,255,611 | B1 | 7/2001 | Chou | |
| 6,717,084 | B1 * | 4/2004 | Lu | 200/467 |
| 8,115,131 | B2 † | 2/2012 | Domzalski | |
| 8,124,896 | B2 † | 2/2012 | Ruff | |
| 2012/0152714 | A1 * | 6/2012 | Kishi et al. | 200/467 |

FOREIGN PATENT DOCUMENTS

| | | |
|---|---|---|
| FR | 2905513 | 8/2007 |
| GE | 388062 | 2/1933 |
| JP | 48-45163 | 6/1973 |
| JP | U55-173818 | 12/1980 |
| JP | U57-192631 | 12/1982 |
| JP | 7-6661 | 1/1995 |
| JP | 2008-066082 | 3/2008 |
| JP | 2008-210654 | 9/2008 |

OTHER PUBLICATIONS

Supplementary European Search Report dated Jan. 2, 2013 from European Application No. 09814658.2.

* cited by examiner
† cited by third party

SWITCH DEVICE AND METHOD OF ASSEMBLING SNAP ACTION MECHANISM

CLAIM OF PRIORITY

This application is a Continuation of International Application No. PCT/JP2009/066345 filed on Sep. 18, 2009, which claims benefit of Japanese Patent Application No. 2008-243271 filed on Sep. 22, 2008 and No. 2009-181519 filed on Aug. 4, 2009). The entire contents of each application noted above are hereby incorporated by reference.

BACKGROUND OF THE INVENTION

1. Field of the Invention

The present invention relates to a switch device, and particularly, to a switch device including a snap action mechanism that is operated depending on a pressing operation against an operation member.

2. Description of the Related Art

Hitherto, a switch device has been suggested in which a common contact point is provided on an inner bottom surface of a wafer, a return spring having a satisfactory conductivity, which is electrically connected to a movable contact point, and which biases a slider in a direction opposite to a pressing operation direction, is mounted on the common contact point, a normal close contact point and a normal open contact point are provided on an inner wall surface of the wafer, and an elastic piece of the movable contact point is brought into sliding contact with the inner wall surface (for example, see Japanese Unexamined Patent Application Publication No. 7-6661, FIG. 1). In the switch device, the normal close contact point and the normal open contact point are provided on the inner wall surface of a case which become sliding surface of the movable contact point, and circuit switch-over is performed by separating the movable contact points. Since these interval or disposition position of both contact points may be set arbitrarily without limiting the common contact point, the circuit switch-over may be performed according to purpose of use at given timing.

SUMMARY OF THE INVENTION

Incidentally, if a plurality of circuits can be synchronized and switched by the above-mentioned switch device, redundancy can be secured and a switch device having superior obstacle resistance can be provided. However, since the switch device of the related art has a configuration which brings the movable contact point into sliding contact with the inner wall surface of the case depending on the pressing operation, there was a problem in that the irregularity in synchronization timing of the circuit switch-over is enlarged.

The invention provides a switch device that can reduce the irregularity of the synchronization timing of the circuit switch-over even in a case where the plurality of circuits is synchronized and switched.

The switch device of the invention includes a housing having a receiving portion, an operation member that receives a pressing operation, a plurality of fixed contact points provided in the receiving portion at predetermined intervals, a plurality of movable contact points having contact point portions that come into sliding contact with the fixed contact points, and a snap action mechanism that drives the movable contact points when the operation member is pressed to a predetermined position, wherein the snap action mechanism has a plurality of first driving bodies which has the movable contact points provided at one end side thereof and is formed with a fulcrum portion constituting a rotation fulcrum, a second driving body which is formed with a pressing target portion to be pressed by the operation member at one end side thereof and is formed with a fulcrum portion constituting a rotation fulcrum at the other end side thereof, and a tensile spring which is attached to a part of a first driving body member in which the plurality of first driving bodies is integrally connected to each other by a connecting member and a part of the second driving body at both ends.

According to the switch device, since it includes the snap action mechanism that drives the movable contact points, when the operation member is pressed to a predetermined position, the movable contact points provided in the first driving body member can be driven in an instant by the biasing force of the tensile spring. Thus, it is possible to reduce the irregularity of the synchronization timing of the circuit switch-over even in a case where a plurality of circuits is synchronized and switched.

In the switch device, it is desirable that a reinforcing member is embedded in the connecting member in a partially exposed state, and one end of the tensile spring is attached to the exposed portion of the reinforcing member. In this case, since the one end of the tensile spring is attached to the exposed portion of the reinforcing member embedded in the connecting member, which can make an occurrence of a situation, in which the connecting member is deformed by the biasing force of the tensile spring, difficult, it is possible to secure the position accuracy of the movable contact points provided in the plurality of first driving bodies which are integrally connected to each other and switch the plurality of circuits at a suitable timing.

Furthermore, in the switch device, it is desirable that the first driving bodies include a conductor plate formed with the fulcrum portion, and the movable contact points attached to the conductor plate, in which an attachment portion of the movable contact point relative to the conductor plate is embedded in the connecting member. In this case, since the attachment portion of the movable contact point is embedded in the connecting member, whereby the movable contact point can be firmly provided in the first driving bodies, a situation in which the movable contact is missed or deviated can be prevented, and it is possible to secure the position accuracy of the movable contact points provided in the plurality of first driving bodies, which are integrally connected to each other, and switch the plurality of circuits at a suitable timing.

Particularly, in the switch device, it is desirable that the reinforcing member is constituted by a part of the conductor plate. In this case, since a part of the conductor plate can also serve as the reinforcing member, the connecting member can be reinforced without preparing a special member.

Furthermore, in the switch device, it is desirable that the conductor plate and the movable contact point are formed of separate materials, and a material of the conductor plate has rigidity higher than that of a material of the movable contact point. In this case, since the rigidity of the material of the conductor plate can be higher than that of the movable contact point, for example, it is possible to secure the rigidity required for the fulcrum portion or the rigidity required for the reinforcing member in the conductor plate.

Furthermore, in the switch device, it is desirable that a pair of pieces of the movable contact point is connected in the first driving bodies side, the contact point portions are provided in a front end in a side opposite to the first driving bodies, respectively, and a portion in which the contact point portions of the pair of pieces of the movable contact point are provided, is disposed oppositely so as to extend to an upper side. In this case, since a lower side portion of the movable contact point can be opened, it is possible to prevent a situation in which the contact point of the movable contact point is damaged by the contact between the fixed contact point and the movable contact point portion when the movable contact point is assembled in the switch device.

Moreover, in the switch device, it is desirable that the tensile spring is attached to a part of the first driving body member and a part of the second driving body member in a position between the adjacent first driving bodies. In this case, since the tensile spring is attached the second driving body member in a position between the adjacent first driving bodies, the movable contact point provided in the adjacent first driving bodies can be driven by the biasing force of the same tensile spring, and thus it is possible to further reduce the irregularity of the synchronization timing of the circuit switch-over.

Moreover, in the switch device, it is desirable that, in a part of the first driving body member and a part of the second driving body, an engagement means is provided which is engaged depending on the biasing force of the tensile spring and integrates the first driving body member and the second driving body. In this case, since the first driving body member and the second driving body can be handled in an integrated state, it is possible to improve the working efficiency upon being assembled in the receiving member.

Moreover, in the switch device, it is desirable that, in a direction side to which a tensile load of the tensile spring of a common contact point of the fixed contact point erected in the receiving portion, a protruding wall, which is adjacent to and faces the front end of the common contact point, is provided on the inner wall surface of the housing. In this case, it is possible to always suppress a situation in which the common contact point, to which the spring load of the tensile spring is added, collapses due to the heat generated due to a fixing work or the like of a terminal relative to the substrate, by the protruding wall provided in a direction side to which the spring load of the tensile spring is added.

Moreover, in the switch device, it is desirable that the fixed contact point is disposed in a position which is more distant than a disposition position of the fulcrum portion of the second driving body from a disposition position of the fulcrum portion of the first driving bodies. In this case, since the fixed contact point with which the movable contact point comes into sliding contact is disposed in a position that is more distant than the fulcrum portion of the second driving body, the movement distance of the movable contact point can be sufficiently obtained, and thus it is possible to easily perform the contact point switch-over.

Moreover, in the switch device, it is desirable that the lower surface of the connecting member of the first driving body member comes into contact with a supporter, and the rotation of the first driving body member in a lower direction due to the spring load of the tensile spring is restricted. In this case, since the rotation of the first driving body member in a lower direction can be suppressed by the contact between the lower surface of the connecting member and the supporter, the first driving body member can be rotated in a predetermined scope, whereby it is possible to prevent a situation in which the first driving body member is rotated to the lower side in more than a predetermined position and the movable contact point or the like is damaged.

Moreover, in the switch device, it is desirable that an upper surface of the connecting member of the first driving body member comes into contact with the housing, and the rotation of the first driving body member in the upper direction due to the spring load of the tensile spring is restricted. In this case, since the rotation of the first driving body member in the upper direction can be restricted by the contact between the upper surface of the connecting member and the housing, the first driving body member can be rotated in a predetermined scope, whereby it is possible to prevent a situation in which the first driving body member is rotated to the upper side in more than a predetermined position and the movable contact point or the like is damaged.

Moreover, in the switch device, it is desirable that, in the second driving body, a mounting portion capable of being mounted on the support portion provided in the housing at the time of assembling work is provided, and the fulcrum portion is formed in an end portion of a part of the mounting portion. In this case, since the fulcrum portion is formed in a part of the mounting portion capable of mounting the second driving body, the mounting portion can include a function of the fulcrum portion, whereby the configuration of the second driving body can be simplified.

Moreover, in the switch device, it is desirable that, in the switch-over contact point of the fixed contact point, an allowance portion, which allows the disposition of the fulcrum portion of the second driving body at the time of the assembling work, is provided. In this case since the fulcrum portion of the second driving body can be disposed in the allowance portion at the time of the assembling work, when the tensile spring is attached between the first driving body member and the second driving body, the second driving body can be disposed in a position where the tensile spring is easily attached.

Moreover, in the switch device, it is desirable that the mounting portion includes a first mounting portion of the common contact point side of the fixed contact point and a second mounting portion of the switch-over contact point side of the fixed contact point, and the second mounting portion is formed to be longer than the first mounting portion in a direction from the common contact point to the switch-over contact point. In this case, since the mounting portion is constituted by the first mounting portion of the common contact point and the second mounting portion of the switch-over contact point side, the mounting portion can be stably mounted on the support portion of the housing. Furthermore, since the second mounting portion is formed to be longer than the first mounting portion, it is possible to stably move the second driving body in a slide manner, while maintaining the state in which the second driving body is supported in the support portion of the housing.

Moreover, in the switch device, it is desirable that, in the first driving body member, a rotation restriction portion is provided which comes into contact with the common contact point of the fixed contact point to restrict the rotation due to the spring load of the tensile spring at the time of the assembling work, and in the second driving body member, a rotation restriction portion is provided which comes into contact with the housing to restrict the rotation due to the spring load of the tensile spring at the time of the assembling work. In this case, since the rotation of the first driving body member can be restricted by the contact between the rotation restriction portion of the first driving body member with the common contact point, and the rotation of the second driving body can be restricted by the contact between the rotation restriction portion of the second driving body and the housing, the first driving body member and the second driving body can be maintained in the stable state in the process of the assembling work, whereby the work efficiency of the assembling work can be improved.

A method of assembling a snap action mechanism according to the invention includes mounting a second driving body on a housing provided with a fixed contact point in a predetermined position relative to the fixed contact point; mounting first driving bodies on the second driving body; attaching a tensile spring between a part of the first driving bodies and a part of the second driving body to push the second driving body toward one side; and disposing a fulcrum portion of the second driving body, which is provided at the other side, in a concave portion of the housing and assembling the same in a predetermined position of the housing by the spring load of the tensile spring.

According to the method of assembling the snap action mechanism, since the first driving bodies and the second driving body can be disposed in a predetermined position of the housing, only by mounting the second driving body and the first driving bodies in the housing and attaching a tensile spring on both, and then disposing the fulcrum of the second driving body in the concave portion of the housing, it is possible to simply assemble the snap action mechanism without requiring complicated work.

In the method of assembling the snap action mechanism, it is desirable that a part of the first driving bodies comes into contact with the common contact point of the fixed contact point to restrict the rotation due to the spring load of the tensile spring, and a part of the second driving body comes into contact with the housing to restrict the rotation due to the spring load of the tensile spring. In this case, since the rotation of the first driving bodies can be restricted by the contact between a part of the first driving bodies and the common contact point, and the rotation of the second driving body can be restricted by the contact between a part of the second driving body and the housing, the first driving bodies and the second driving body can be maintained in the stable state in the process of the assembling work, whereby the work efficiency of the assembling work of the snap action mechanism can be improved.

In the method of assembling the snap action mechanism, it is desirable that the tensile spring is disposed in a state in which the first driving bodies are mounted in parallel to the second driving body. In this case, since the tensile spring is attached in a state in which the first driving bodies and the second driving body are in parallel, the tensile spring can be attached without separately preparing a jig or the like that maintains them in a predetermined state, whereby it is possible to improve the work efficiency of the assembling work of the snap action mechanism.

According to the invention, the snap action mechanism driving the movable contact point is included, and when the operation member is pressed to a predetermined position, the movable contact point provided in the first driving body member can be driven in an instant by the biasing force of the tensile spring. Thus, even when a plurality of circuits is synchronized and switched, the irregularity of the synchronization timing of the circuit switch-over can be reduced.

DESCRIPTION OF THE PREFERRED EMBODIMENTS

First Embodiment

Hereinafter, a first embodiment of the invention will be described with reference to the attached drawings in detail.

Figure 1:
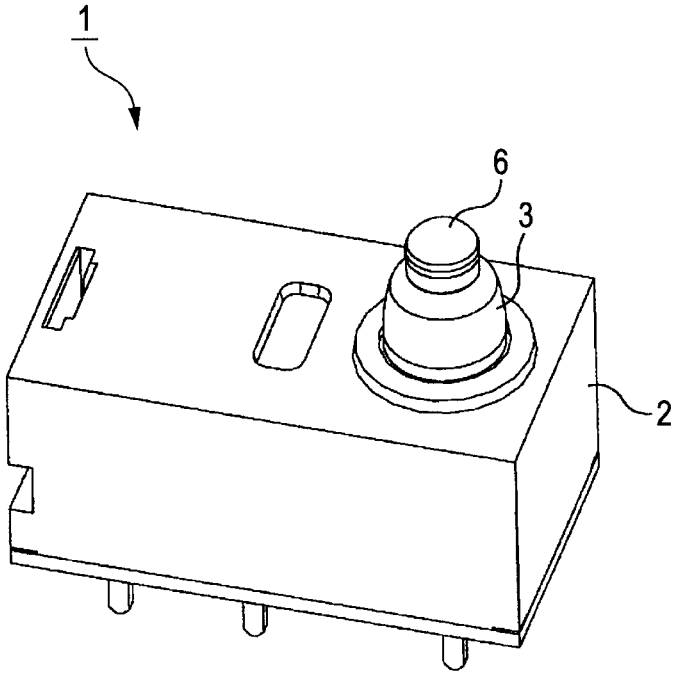
FIG. 1 is a perspective view that shows an exterior of a switch device according to a first embodiment of the invention.
Figure 2:
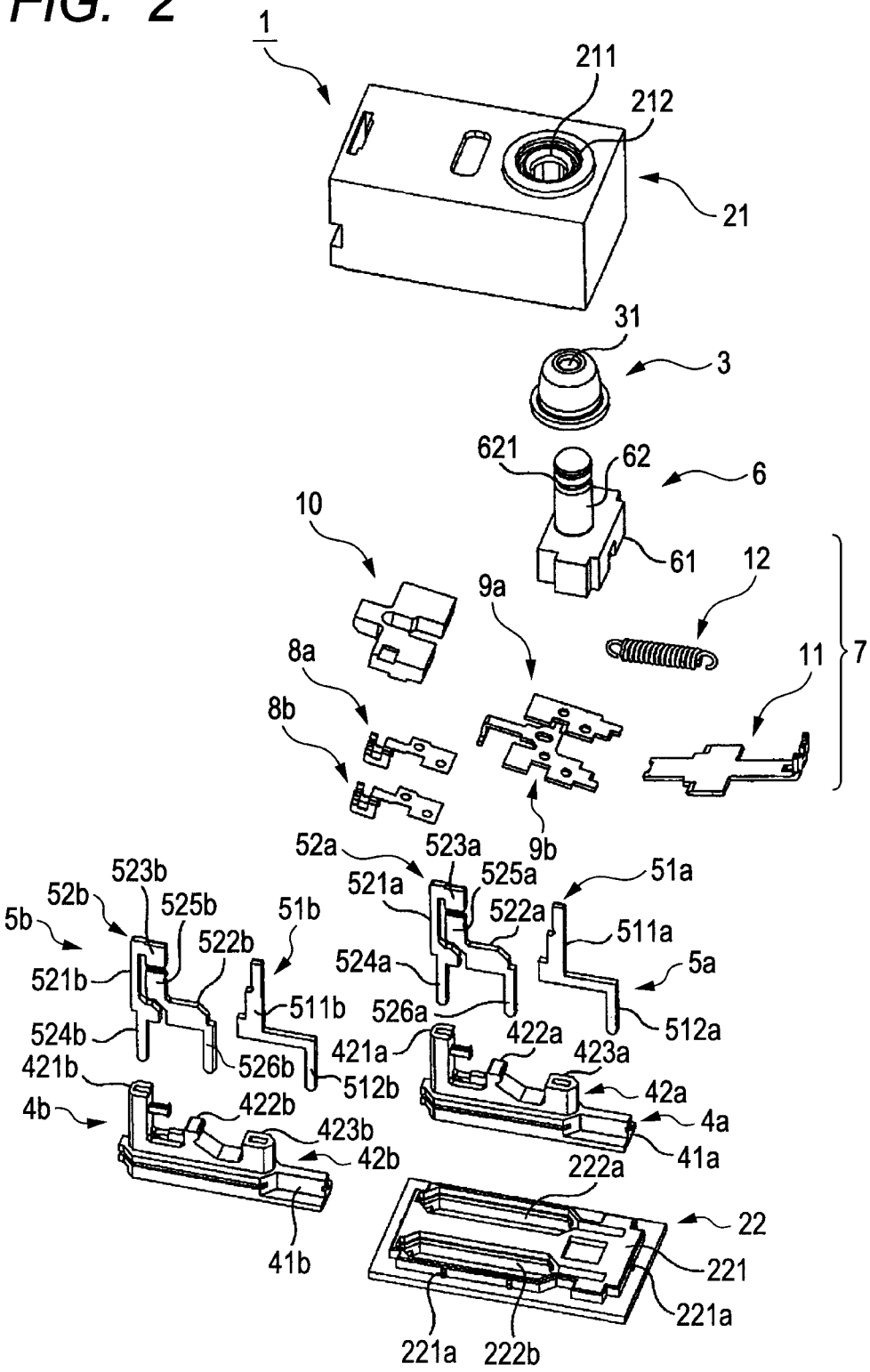
FIG. 2 is an exploded perspective view of the switch device according to the first embodiment.

FIG. 1 is a perspective view that shows an exterior of a switch device 1 according to a first embodiment of the invention. FIG. 2 is an exploded perspective view of the switch device 1 according to the first embodiment. As shown in FIG. 1, the switch device 1 according to the first embodiment is configured so that a part of an operation member 6 described later is protruded from a part of an upper surface of a housing 2 of a box shape and a pressing operation from an operator or the like is received in the protrusion portion. A cover 3 for preventing foreign matters such as dust and water from entering the housing 2 is attached to a part of the operation member 6 protruding from the housing 2.

As shown in FIG. 2, the switch device 1 includes a housing 2 formed, for example, by molding an insulative resin material. The housing 2 has an upper case 21 having a box shape opened to the lower part side and a lower case 22 that has a shape corresponding to an opening of the upper case 21 and constitutes an inner bottom surface of the switch device 1. By combining the upper case 21 with the lower case 22, in the inner portion of the housing 2, a receiving portion, which receives the components of the switch device 1, is formed.

On the upper surface of the upper case 21, an opening portion 211 is formed through which an upper end portion of a shaft portion 62 of an operation member 6 described later can penetrate. On the upper surface of the case 2, around the opening portion 211, a groove portion 212 is formed into which an outer peripheral portion of the cover 3 is inserted. The lower case 22 has a rectangular shape when seen from the plane and a protrusion surface 221 having a shape corresponding to the opening of the upper case 21 is provided on the upper surface thereof. The upper case 21 is suitably positioned by accommodating the protrusion surface 221 in the opening. A plurality of protrusions 221*a* protruding to the lateral side is provided around the protrusion surface 221. When the upper case 21 is covered on the lower case 22, the protrusion 221*a* is pressed into an inner wall surface of the upper case 21, whereby the upper case 21 is attached to the lower case 22. Furthermore, on the protrusion surface 221, two opening portions 222*a* and 222*b* are formed along a long side of the upper case 21. Supporters 4*a* and 4*b* described later are disposed in the opening portions 222*a* and 222*b*.

In the receiving portion formed in the housing 2, a pair of supporters 4*a* and 4*b* and a pair of fixed contact points 5*a* and 5*b* fixed to the lower case 22 are disposed, and an operation member 6, which receives a pressing operation by an operator or the like, and a snap action mechanism 7, which is operated depending on the pressing operation relative to the operation member 6, are received. The snap action mechanism 7 (the details thereof will be described later) includes a first driving body member 90 (not shown in FIG. 2, see FIG. 5) in which the first driving bodies 9*a* and 9*b*, to which the pair of movable contact points 8*a* and 8*b* are attached, are connected by a connecting member 10, a second driving body 11, and a tensile spring 12 to which the first driving body member 90 and the second driving body 11 are attached at both end portions.

The supporter 4*a* is formed, for example, by molding an insulative resin material, and has a foundation portion 41*a* having a shape corresponding to the opening portion 222*a* of the lower case 22, and a protruding portion 42*a* provided so as to protrude upward from the foundation portion 41*a*. The protruding portion 42*a* has three protruding pieces 421*a* to 423*a*. The supporter 4*a* is integrated with the opening portion 222*a* by the foundation portion 41*a* and is configured so as to support a part of the fixed contact point 5*a* subjected to an insert molding by the protruding portion 42*a*. In addition, since the supporter 4*b* is disposed in the opening portion 222*b* of the lower case 22 and has the same configuration as the supporter 4*a* except that the fixed contact point 5*b* is subjected to the insert molding, a symbol b is added to the drawings such as a foundation portion 41*b*, and the description thereof will be omitted.

The supporters 4*a* and 4*b* are integrated with the lower case 22 and are formed by so-called double molding. In the double molding, the fixed contact points 5*a* and 5*b* are subjected to the insert molding upon forming the supports 4*a* and 4*b*, and after the supporters 4*a* and 4*b* are molded and formed, a lower case 22 is molded in the foundation portions 41*a* and 41*b* of the supporters 4*a* and 4*b*. At the time of the molding, the opening portions 222*a* and 222*b* are formed. However, a method of providing the supporters 4*a* and 4*b* in the lower case 22 is not limited thereto but can suitably be changed. For example, the supporters 4*a* and 4*b*, in which the fixed contact points 5*a* and 5*b* are subjected to the inset molding, may be disposed in the opening portions 222*a* and 222*b* of the lower case 22 and they may be fixed and integrated by an adhesive or the like.

The fixed contact point 5*a* has a common contact point 51*a* and a switch-over contact point 52*a* subjected to the insert molding in the supporter 4*a*. The common contact point 51*a* and the switch-over contact point 52*a* are erected so as to be separated at a certain distance along a longitudinal direction of the supporter 4*a*. The common contact point 51*a* extends upward from the protruding piece 423*a*, and has a contact portion 511*a* which comes into contact with a fulcrum portion 92*a* of a first driving body 9*a* described later, and a terminal portion 512*a* which is bent from the contact portion 511*a* to a side opposite to a switch-over contact point 52*a* and extends downward from the end portion.

The switch-over contact point 52*a* has a first switch-over contact point 521*a* which is slightly protruded from the protruding piece 421*a*, and a second switch-over contact point 522*a* which is embedded near the protruding piece 422*a* and is disposed near the first switch-over contact point 521*a*. The first switch-over contact point 521*a* has a slide-contact portion 523*a* into which the movable contact point 8*a* comes into sliding contact, and a terminal portion 524*a* which is extended downward from the slide-contact portion 523*a*. Meanwhile, the second switch-over contact point 522*a* has a slide-contact portion 525*a* into which the movable contact point 8*a* comes into sliding contact, and a terminal portion 526*a* which is bent from the lower end portion of the slide-contact portion 525*a* to the common contact point 51*a* side and is extended downward from the end portion. In this case, the lower end portion of the slide-contact portion 523*a* of the first switch-over contact point 521*a* and the upper end portion of the slide-contact portion 525*a* of the second switch-over contact point 522*a* are closely disposed. A contact point portion 83*a* of the movable contact point 8*a* described later is moved between the slide-contact portion 523*a* and the slide-contact portion 525*a*, whereby the state of the circuit is switched.

In the switch device 1 according to the first embodiment, the first switch-over contact point 521*a* constitutes a normal close contact point, while the second switch-over contact point 522*a* constitutes a normal open contact point. It is configured so as to be switched to a circuit in which, in a case where the contact point portion 83*a* of the movable contact point 8 described later is in contact with the slide-contact portion 523*a*, the first switch-over contact point 521*a* as the normal close contact point is connected to the common contact point 51*a*, while, in a case where the contact point portion 83*a* of the movable contact point 8 comes into contact with the slide-contact portion 525*a*, the second switch-over contact point 522*a* as the normal open contact point is connected to the common contact point 51*a*. Furthermore, the same circuit is also included between the common contact point 51*b* and the switch-over contact point 52*b* (the first switch-over contact point 521*b* and the second switch-over contact point 522*b*). Moreover, the movable contact points 8*a* and 8*b* are driven in an instant by the operation of the snap action mechanism 7 described later, and the circuit is synchronized and switched.

The operation member 6 is formed, for example, by molding an insulative resin material, and has a pressing portion 61 having approximately a rectangular shape, and a cylindrical shaft portion 62 erected on the upper surface of the pressing portion 61. The pressing portion 61 presses an end of the second driving body depending on the pressing operation relative to the operation member 6. On a lower surface of the pressing portion 61, an accommodation portion 611 which accommodates an end of the second driving body 11 is provided (not shown in FIG. 2, see FIG. 14). The shaft portion 62 is disposed so as to protrude from the upper end portion thereof of the opening portion 211 of the upper case 21 and receives the pressing operation. A groove portion 621 is formed in the outer periphery near the upper end portion of the shaft portion 62. An inner edge portion of a hole 31 formed on the upper surface of the cover 3 is disposed in the groove portion 621. In addition, in FIG. 2, for the convenience of description, the cover 3 is disposed upward from the operation member 6, but, actually, the cover 3 is disposed outside the upper case 21.

Figure 3:
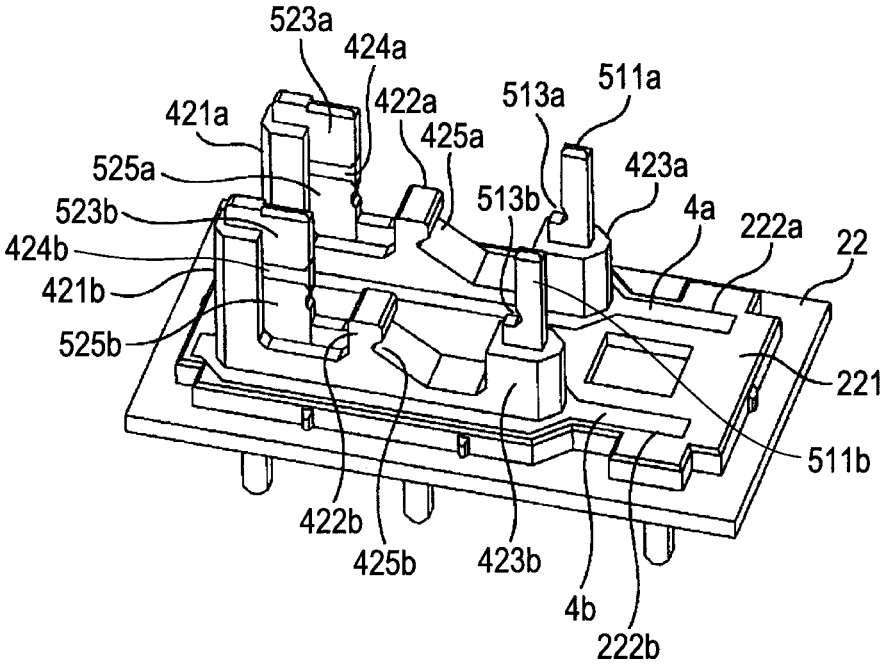
FIG. 3 is a perspective view of a lower case in which a supporter and a fixed contact point are fixed in the switch device according to the first embodiment.
Figure 4A:
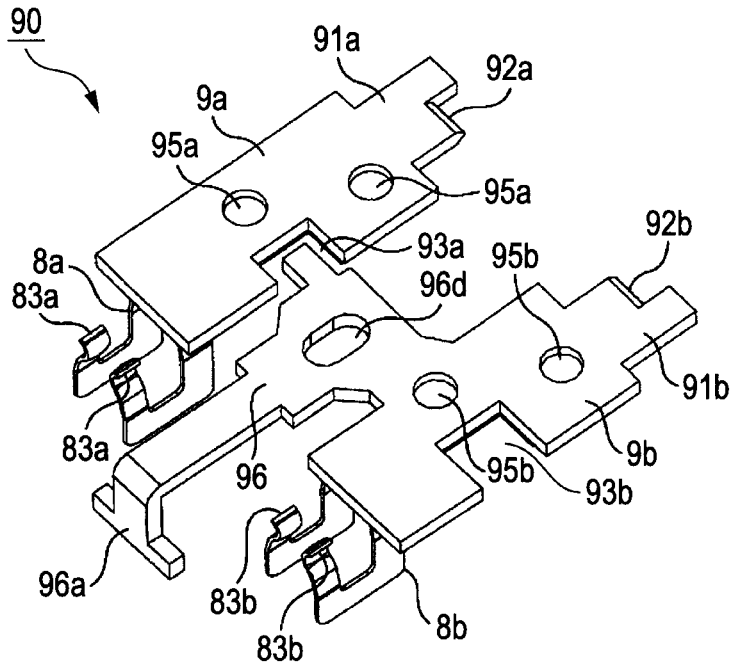
FIG. 4 is a perspective view of a first driving body member included in the switch device according to the first embodiment.
Figure 4B:
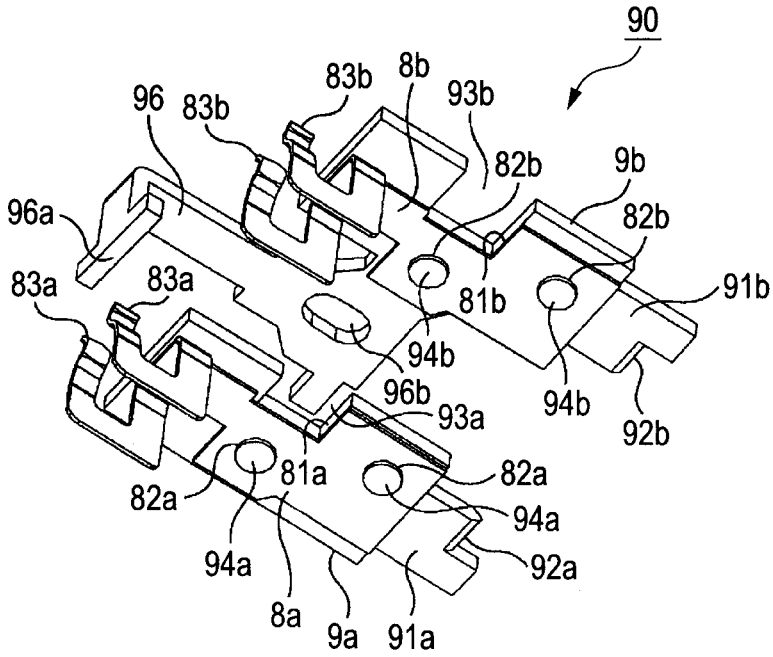
Figure 5A:
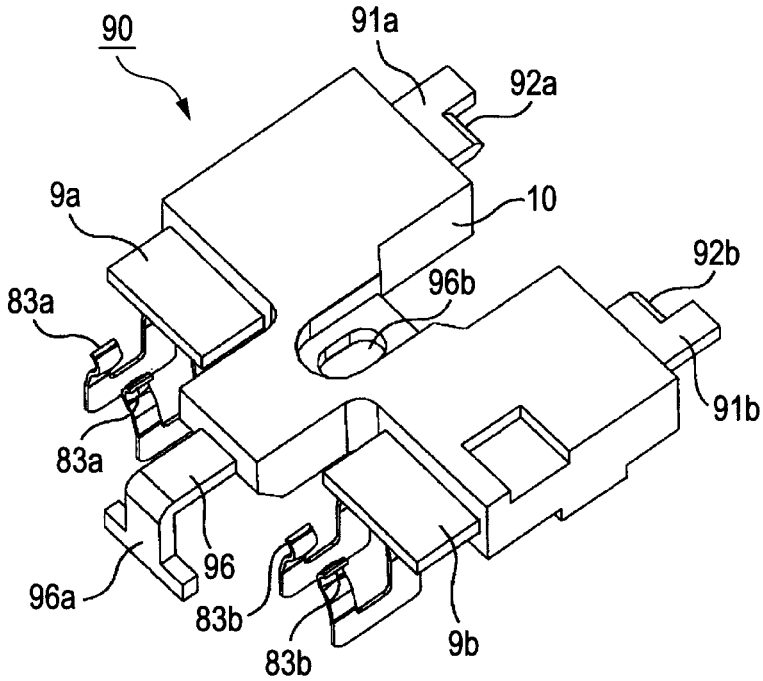
FIG. 5 is a perspective view of a first driving body member included in the switch device according to the first embodiment.
Figure 5B:
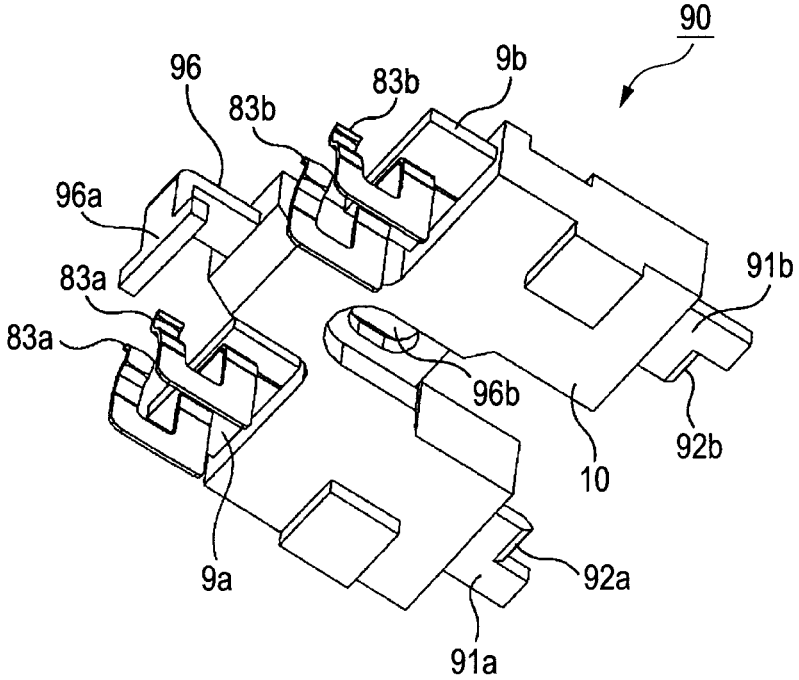
Figure 6:
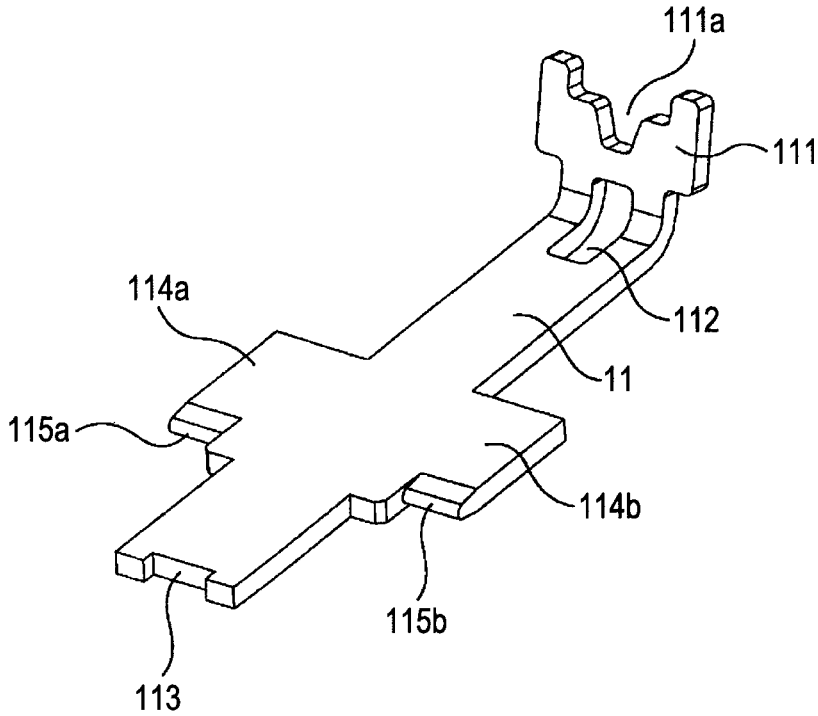
FIG. 6 is a perspective view of a second driving body member included in the switch device according to the first embodiment.

Herein, a configuration of principal parts of the switch device 1 according to the first embodiment will be described. FIG. 3 is a perspective view of the lower case 22 in which the supporter 4 and the fixed contact point 5 in the switch device 1 according to the first embodiment are fixed. FIGS. 4 and 5 are perspective views of a first driving body member 90 included in the switch device 1 according to the first embodiment. In addition, in FIG. 4, the connecting member 10 is omitted from the first driving body member 90. FIG. 6 is a perspective view of a second driving body 11 included in the switch device 1 according to the first embodiment.

As shown in FIG. 3, the supporters 4*a* and 4*b* are disposed in the opening portions 222*a* and 222*b* of the lower case 22. In this case, the upper surfaces of the supporters 4*a* and 4*b* are disposed at the same height as the upper surface of the protruding surface 221, and only the protruding portions 42*a* and 42*b* are protruded upward from the protruding surface 221. In addition, the protruding portions 42*a* and 42*b* are provided along the short side of the lower case 22 at a certain distance side by side.

The fixed contact point 5*a* is embedded in the supporter 4*a* disposed in the lower case 22 in this manner. The common contact point 51*a* is disposed so that the contact portion 511*a* is protruded from the upper end portion of the protruding piece 423*a*. In the vicinity of the protruding piece 423*a* in the contact portion 511*a*, a concave portion 513*a* is formed at the switch-over contact point 52*a* side. The concave portion 513*a* is a portion that accommodates a fulcrum portion 92*a* of the first driving body 9*a* described later. By accommodating the fulcrum portion 92*a* of the first driving body 9*a* by the concave portion 513*a*, the contact portion 511*a* rotatably supports the first driving body 9*a*.

Among the switch-over contact points 52*a*, the first switch-over contact point 521*a* is disposed so that the slide-contact portion 523*a* is protruded from the upper end portion of the protruding piece 421*a* over the side surface portion thereof. The second switch-over contact point 522*a* is disposed so that the slide-contact portion 525*a* is protruded from the side surface of the protruding piece 421*a*. On the side surface of the protruding piece 421*a*, an insulation piece 424*a* to be disposed between the slide-contact portion 523*a* and the slide-contact portion 525*a* is provided. The insulation piece 424*a* is a portion that temporarily blocks the connection state of the movable contact point 8*a* which is moved up and down along with the pressing operation relative to the operation member 6. The insulation piece 424*a* is provided so as to constitute the same plane as the slide-contact portion 523*a* and the slide-contact portion 525*a*, and the contact point portion 83*a* of the movable contact point 8*a* can smoothly slide between the slide-contact portion 523*a* and the slide-contact portion 525*a*.

The protruding piece 422*a* is provided between the protruding piece 421*a* and the protruding piece 423*a*. On the side surface of the protruding piece 423*a* side (the common contact point 51*a* side) of the protruding piece 422*a*, a concave portion 425*a* is provided. The concave portion 425*a* is a portion that accommodates a fulcrum portion 115*a* of a second driving body 11 described later. By accommodating the fulcrum portion 115*a* of the second driving body 11 by the concave portion 425*a*, the protruding piece 422*a* can rotatably support the second driving body 11. In addition, the concave portion 425*a* is provided at a position lower than the concave portion 513*a* provided in the common contact point 51*a*.

The fixed contact point 5*b* embedded in the supporter 4*b* is disposed similarly to the fixed contact point 5*a* embedded in the supporter 4*a*. Furthermore, in the contact portion 511*b* of the common contact point 51*b* protruding from the upper end portion of the protruding piece 423*b* of the supporter 4*b*, a concave portion 513*b* is also provided. In addition, in the protruding piece 422*b* of the supporter 4*b*, a concave portion 425*b* is also provided. The role of the concave portion 513*b* and the concave portion 425*b* are the same as the concave portion 513*a* and the concave portion 425*a*. In addition, other configurations of the supporter 4*b* and the fixed contact point 5*b* are also the same as the configurations of the supporter 4*a* and the fixed contact point 5*a*.

As shown in FIG. 4, in the first driving body member 90, the first driving bodies 9*a* and 9*b* are constituted by conductor plates having the approximately rectangular shape and are disposed parallel to each other. In one end sides of the first driving bodies 9*a* and 9*b*, protruding pieces 91*a* and 91*b* are provided. Inner portions of the end portions of the protruding pieces 91*a* and 91*b* are formed to be shorter than outer portions thereof, and fulcrum portions 92*a* and 92*b* are provided in the end surfaces of the inner portions. The fulcrum portions 92*a* and 92*b* come into contact with the concave portions 513*a* and 513*b* provided in the contact point portions 511*a* and 511*b* and constitute the rotation fulcrums of the first driving bodies 9*a* and 9*b*.

Furthermore, on the side surfaces of the first driving bodies 9*a* and 9*b*, notch portions 93*a* and 93*b* are formed. The notch portions 93*a* and 93*b* are used at the time of the positioning of the movable contact points 8*a* and 8*b* attached to the lower surfaces of the first driving bodies 9*a* and 9*b*. In the lateral side portions of the notch portions 93*a* and 93*b* and in the portions between the notch portions 93*a* and 93*b* and the protruding pieces 91*a* and 91*b*, circular protruding portions 94*a* and 94*b* protruding downward are provided (FIG. 4B). The circular protruding portions 94*a* and 94*b* are used when attaching the movable contact point portions 8*a* and 8*b* to the lower surfaces of the first driving bodies 9*a* and 9*b*. In addition, the circular protruding portions 94*a* and 94*b* are formed by press machining of the first driving bodies 9*a* and 9*b*, and the concave portions 95*a* and 95*b* are provided in the portions corresponding to the upper surfaces thereof.

In addition, on the side surface portion of a side of the first driving body 9*b* opposite to the notch portion 93*b*, a reinforcing portion 96*b* as a reinforcing member extending to the side opposite to the protruding piece 91*b* in the position between the side surface portion and the first driving body 9*a* is provided. The front end of the reinforcing portion 96 extends to the position in front of the contact point portions 83*a* and 83*b* of the movable contact points 8*a* and 8*b* described later. Moreover, in the front end portion thereof, an engagement piece 96*a* is provided which is bent to the lower side and has a T shape. The engagement piece 96*a* functions as a part of an engagement means and is engaged with an engagement concave portion 113 of the second driving body 11 described later. Moreover, a hole 96*b* is provided near a proximal end portion of the reinforcing portion 96. The hole 96*b* is disposed in the center of the first driving bodies 9*a* and 9*b* and an end of the tensile spring 12 is attached thereto.

In the switch device 1 according to the first embodiment, since an end of the tensile spring 12 is attached to the hole 96*b* provided in the reinforcing portion 96, the occurrence of a situation, in which the connecting member 10 described later is deformed by the biasing force of the tensile spring, can be made difficult, whereby it is possible to secure the position accuracy of the movable contact points 8*a* and 8*b* provided in the first driving bodies 9*a* and 9*b*. Particular, since a part of the conductor plate constituting the first driving body 9*b* is used as the reinforcing portion, it is possible to reinforce the connecting member 10 described later without preparing a special member. In addition, as a reinforcing member that reinforces the connecting member 10, a member different from the first driving body 9*b* may be used.

The movable contact points 8*a* and 8*b* are formed by performing pressing machining and bending machining on a thin plate-shaped member having elasticity. In the vicinity of the center of the movable contact points 8*a* and 8*b*, notch portions 81*a* and 81*b* are provided in one side surface portion thereof. Circular opening portions 82*a* and 82*b* are provided near the notch portions 81*a* and 81*b*. The movable contact points 8*a* and 8*b* cause the notch portions 81*a* and 81*b* to correspond to the notch portions 93*a* and 93*b* of the first driving bodies 9*a* and 9*b*, and is positioned in the lower surfaces of the first driving bodies 9*a* and 9*b* by accommodating the circular protruding portions 94*a* and 94*b* of the first driving bodies 9*a* and 9*b* by the circular opening portions 82*a* and 82*b*. Moreover, for example, by twisting the circular protruding portion 94*a* and 94*b*, the movable contact points 8*a* and 8*b* are attached to the first driving bodies 9*a* and 9*b*. In this manner, since the movable contact points 8*a* and 8*b* are attached to the first driving bodies 9*a* and 9*b* by the twist, the first driving bodies 9*a* and 9*b* and the movable contact points 8*a* and 8*b* can be constituted by separate materials, whereby it is possible to constitute the movable contact points 8*a* and 8*b* by a material suitable for the movable contact point without being limited to the materials of the first driving bodies 9*a* and 9*b*. In this case, the movable contact points 8*a* and 8*b* are provided in the end portion side of a side opposite to the protruding pieces 91*a* and 91*b* of the first driving bodies 9*a* and 9*b*.

The movable contact points 8*a* and 8*b* have a pair of pieces having a U shape when seen from the side thereof, and the contact point portions 83*a* and 83*b* having a clip shape connected at the upper end portions of the first driving bodies 9*a* and 9*b* sides are provided in the respective front ends of a side opposite to the first driving bodies 9*a* and 9*b*. That is, the front end portions of the contact point portions 83*a* and 83*b* are extended to the upside of the movable contact points 8*a* and 8*b* and are disposed oppositely at a certain distance. The switch-over contact points 52*a* and 52*b* are disposed between the contact point portions 83*a* and 83*b*, and the contact point portions 83*a* and 83*b* can come into sliding contact with the contact point portions 523*a*, 523*b*, 525*a*, and 525*b* of the switch-over contact points 52*a* and 52*b*. In the movable contact points 8*a* and 8*b*, since the lower side portions thereof can be opened, it is possible to prevent a situation in which the contact point portions 83*a* and 83*b* are damaged by the contact between the switch-over contact points 52*a* and 52*b* and the contact point portions 83*a* and 83*b* of the movable contact points 8*a* and 8*b* when the movable contact points 8*a* and 8*b* are assembled in the switch device 1.

In the first driving body member 90, with respect to the first driving bodies 9*a* and 9*b* disposed in this manner, the connecting member 10 is disposed so that a part of the first driving bodies 9*a* and 9*b* and a part of the reinforcing portion 96 are exposed. That is, as shown in FIG. 5, the connecting member 10 is disposed in a state in which a part of the end portions of the contact point portions 83*a* and 83*b* of the movable contact points 8*a* and 8*b* in the first driving bodies 9*a* and 9*b*, a part of the protruding pieces 91*a* and 91*b*, a part of the front end including the engagement piece 96*a* in the reinforcing portion 96, and a part near the hole 96*b* are exposed. The connecting member 10 is formed, for example, by performing the insert molding of the first driving bodies 9*a* and 9*b* and the movable contact points 8*a* and 8*b* by an insulative resin material. In this case, in the movable contact points 8*a* and 8*b*, as shown in FIG. 5B, since the attachment portion relative to the first driving bodies 9*a* and 9*b*, that is, the portion near the opening portions 82*a* and 82*b* accommodating the circular protruding portions 94*a* and 94*b* is embedded in the connecting member 10, the movable contact points 8*a* and 8*b* are firmly fixed to the lower surfaces of the first driving bodies 9*a* and 9*b*. For this reason, it is possible to prevent a situation in which the movable contact points 8*a* and 8*b* are missed or deviated.

Particular, in the first driving body member 90, the first driving bodies 9*a* and 9*b* are formed by a material different from the movable contact points 8*a* and 8*b* that come into sliding contact with the slide-contact point portions 523*a*, 523*b*, 525*a* and 525*b* of the switch-over contact points 52*a* and 52*b*. The materials of the first driving bodies 9*a* and 9*b* have rigidity higher than those of the movable contact points 8*a* and 8*b*. As a result, the first driving body member 90 can secure elasticity as the movable contact points 8*a* and 8*b* which come into sliding contact with the slide-contact point portions 523*a*, 523*b*, 525*a*, and 525*b*, while securing the rigidity that maintains the tensile spring 12.

The second driving body 11 is formed, for example, by mechanically machining a metallic material. As shown in FIG. 6, the second driving body 11 has approximately a long shape. One end side of the second driving body 11 is bent upward and constitutes a pressing target portion 111 that receives the pressing of the operation member 6 by the upper end portion. In the lower portion of the pressing target portion 111, an opening portion 112 is provided. The other end of the tensile spring 12 with an end attached to the hole 96*b* of the reinforcing portion 96 of the first driving body 9*b* is attached to the opening portion 112. A part of the other end of the tensile spring 12 attached to the opening portion 112 is engaged by the concave portion 111*a* provided in the pressing target portion 111. In addition, the second driving body 11 may be formed by a material having rigidity without being limited to the metallic material.

In the end portion of a side opposite to the pressing target portion 111 in the second driving body 11, an engagement concave portion 113, which is engaged with the engagement piece 96*a* of the reinforcing portion 96 of the first driving body 9*b*, is provided. The engagement concave portion 113 functions as a part of an engagement means and is engaged by disposing an arm portion of a T shape of the engagement piece 96*a* at the lower side and accommodating the base portion thereof.

Furthermore, in the center of the second driving body 11, protruding pieces 114*a* and 114*b* protruding from the lateral side thereof are provided. In the end portion side (the end surface of the engagement concave portion 113 side) of a side opposite to the pressing target portion 111 in the protruding pieces 114*a* and 114*b*, fulcrum portions 115*a* and 115*b* are provided. The fulcrum portions 115*a* and 115*b* come into contact with the concave portions 425*a* and 425*b* provided in the protruding pieces 422*a* and 422*b* of the supporters 4*a* and 4*b*, and constitute the rotation fulcrum of the second driving body 11.

Figure 7:
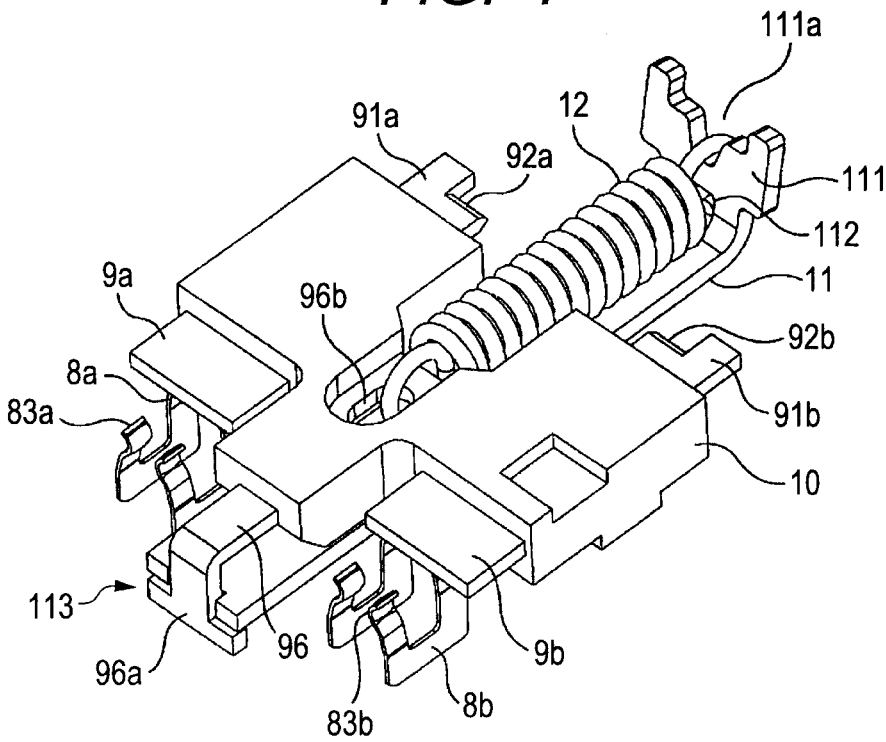
FIG. 7 is a perspective view of a state in which the first driving body member and the second driving body of the switch device according to the first embodiment are integrated with each other.
Figure 8A:
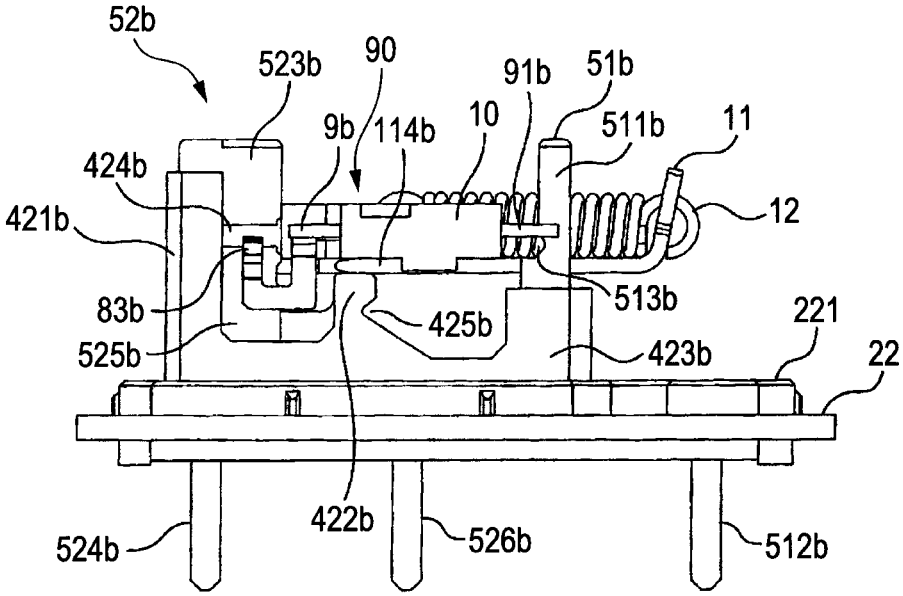
FIGS. 8A and 8B are a side view and a side cross-sectional view which show a process upon assembling the first driving body member and the second driving body that are integrated with the lower case of the state shown in FIG. 3.
Figure 8B:
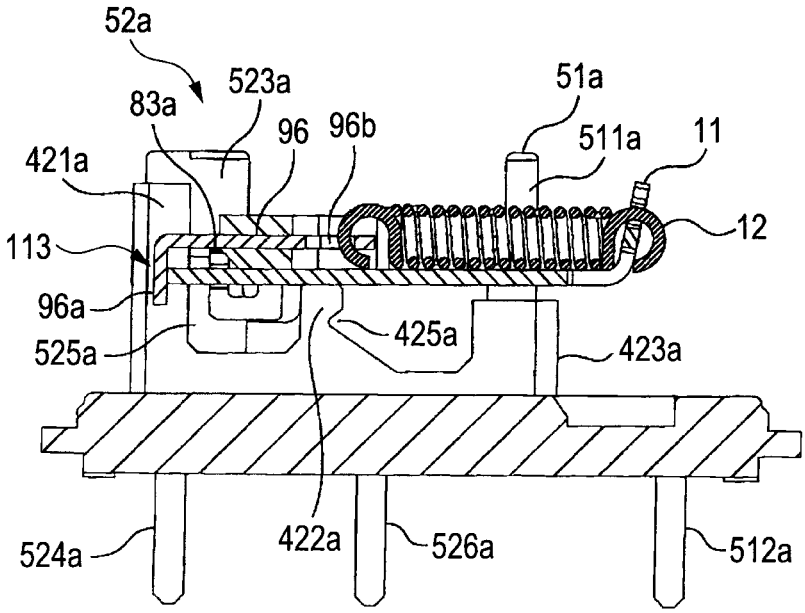
Figure 9A:
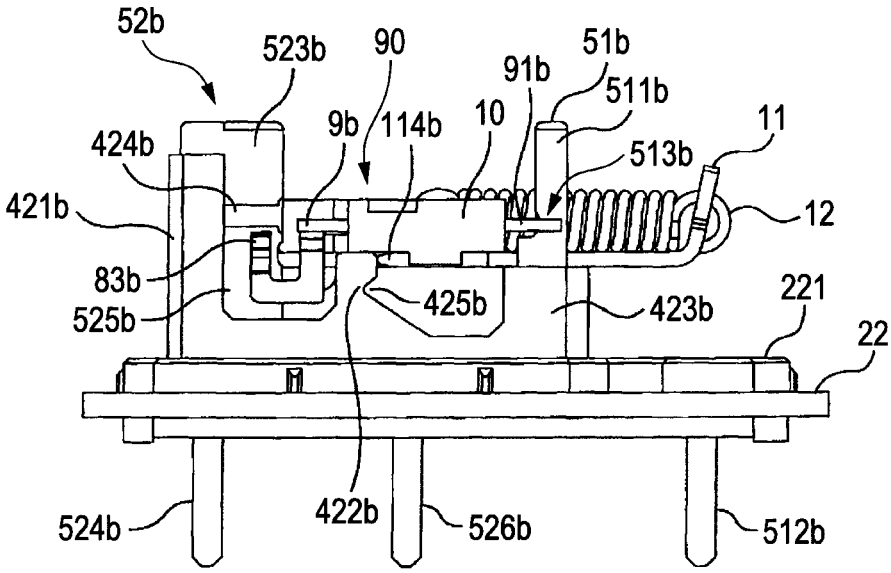
FIGS. 9A and 9B are a side view and a side cross-sectional view which show a process upon assembling the first driving body member and the second driving body that are integrated with the lower case of the state shown in FIG. 3.
Figure 9B:
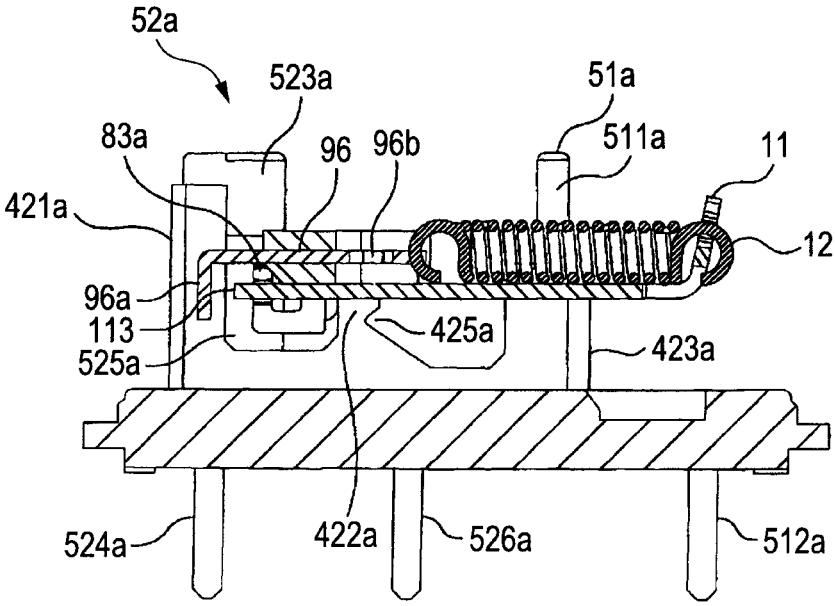
Figure 10A:
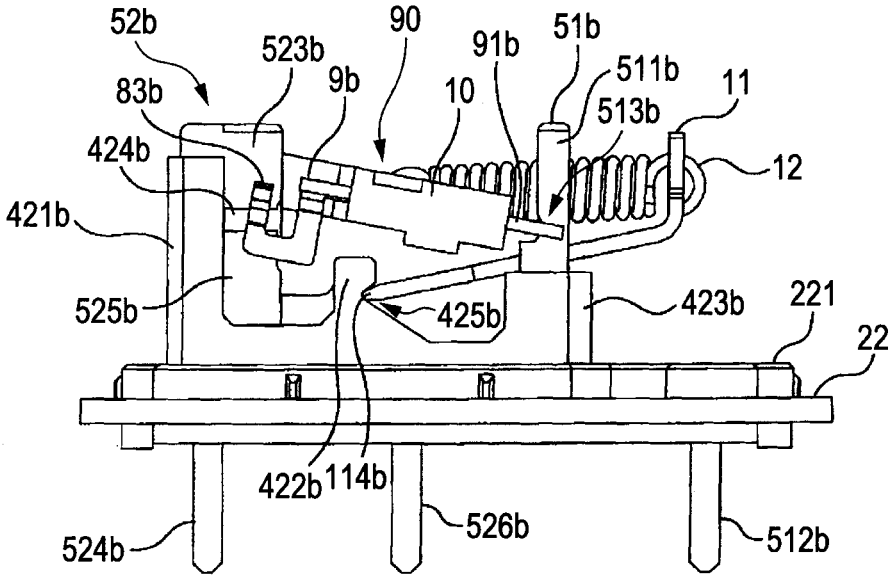
FIGS. 10A and 10B are a side view and a side cross-sectional view which show a process upon assembling the first driving body member and the second driving body that are integrated with the lower case of the state shown in FIG. 3.
Figure 10B:
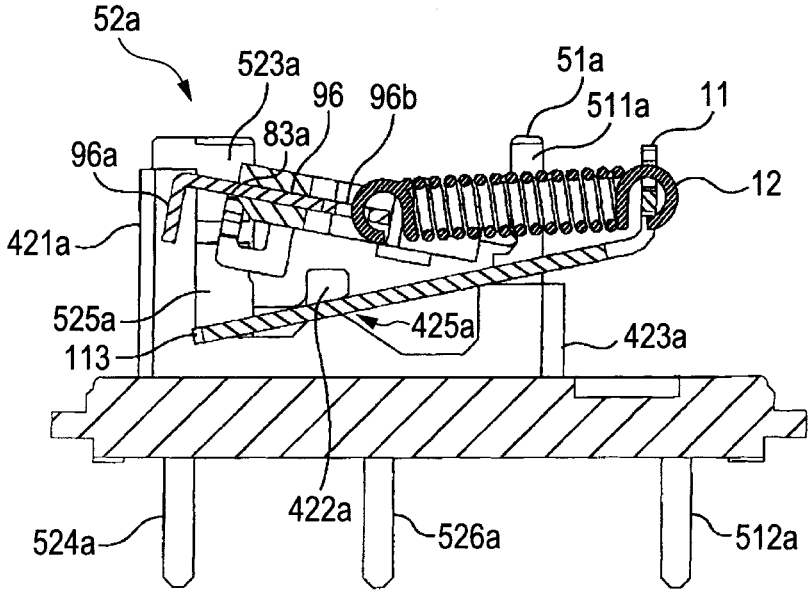

In the switch device 1 according to the first embodiment, the first driving body member 90 and the second driving body 11 are integrated and assembled to the lower case 22 of the state shown in FIG. 3, whereby the snap action mechanism 7 can be assembled. Hereinafter, the state, in which the first driving body member 90 and the second driving body 11 are integrated, will be described, and an operation when the integrated first driving body member 90 and second driving body 11 is assembled to the lower case 22 of the state shown in FIG. 3 will be described. FIG. 7 is a perspective view of a state in which the first driving body member 90 of the switch device 1 according to the first embodiment and the second driving body 11 are integrated with each other. FIG. 8 to FIG. 10 are a side view and a side cross-sectional view that show a process of the time of assembling the first driving body member 90 and the second driving body 11 integrated with the lower case 22 of the state shown in FIG. 3.

As shown in FIG. 7, an end of the tensile spring 12 is attached to the hole 96*b* of the reinforcing portion 96 exposed from the connecting member 10 in the first driving body member 90. Meanwhile, the other end of the tensile spring 12 is attached to the opening portion 112 of the second driving body 11. Moreover, the second driving body 11 is disposed so as to face the reinforcing portion 96 in the lower side of the first driving body member 90, and accommodates a part of the engagement piece 96*a* of the reinforcing portion 96 by the engagement concave portion 113. In this case, the movement to the lower side of one end side of the second driving body 11 is restricted by the engagement piece 96*a*, the movement to the lower side of the other end side of the second driving body 11 is restricted by the tensile spring 12, and the second driving body 11 and the first driving body member 90 are integrated with each other. Moreover, the first driving body member 90 and the second driving body 11 of the integrated state are assembled to the lower case 22. In this case, since the first driving body member 90 and the second driving body 11 can be handled in the integrated state, it is possible to improve work efficiency when assembling these.

When assembling the first driving body member 90 and the second driving body 11 integrated in this manner, as shown in FIG. 8, firstly, the protruding pieces 114*a* and 114*b* are disposed so as to be mounted on the upper surfaces of the protruding pieces 422*a* and 422*b* of the supporters 4*a* and 4*b*. In this case, the first driving body member 90 and the second driving body 11 are disposed so that the switch-over contact points 52*a* and 52*b* are accommodated between the respective contact point portions 83*a* and 83*b* of the movable contact points 8*a* and 8*b*. In this case, as mentioned above, since the movable contact points 8*a* and 8*b* have the configuration in which the lower side portions thereof are opened, the contact point portions 83*a* and 83*b* are not damaged by the contact between the switch-over contact points 52*a* and 52*b* and the contact point portions 83*a* and 83*b* of the movable contact points 8*a* and 8*b*. The contact point portions 83*a* and 83*b* of the movable contact points 8*a* and 8*b* are in sliding contact with the slide-contact point portions 523*a* and 523*b* or the like of the switch-over contact points 52*a* and 52*b*. Furthermore, the protruding pieces 91*a* and 91*b* of the first driving body member 9*a* and 9*b* are disposed at the slight upper sides of the concave portions 513*a* and 513*b* of the common contact points 51*a* and 51*b*.

Next, as shown in FIG. 9, the fulcrum portions 92*a* and 92*b* provided in the protruding pieces 91*a* and 91*b* of the first driving bodies 9*a* and 9*b* are brought into contact with the concave portions 513*a* and 513*b* of the common contact points 51*a* and 51*b*. Moreover, the left side end portion shown in FIG. 9 in the second driving body 11 is pushed to the right side in resistance to the biasing force of the tensile spring 12 to release the engagement of the engagement piece 96*a* and the engagement concave portion 113, and the protruding pieces 114*a* and 114*b* of the second driving body 11 are moved to the concave portions 425*a* and 425*b* of the protruding pieces 422*a* and 422*b* of the supporters 4*a* and 4*b*.

Next, as shown in FIG. 10, the fulcrum portions 115*a* and 115*b* of the protruding pieces 114*a* and 114*b* of the second driving body 11 are brought into contact with the concave portions 425*a* and 425*b* of the protruding pieces 422*a* and 422*b* of the supporters 4*a* and 4*b*. When a hand is taken off in a state in which the fulcrum portions 115*a* and 115*b* are brought into contact with the concave portions 425*a* and 425*b* in this manner, the first driving body member 90 and the second driving body 11 to which the biasing force pulling each other acts by the tensile spring 12 are maintained rotatably in the fulcrum portions 92*a* and 92*b* coming into contact with the concave portions 513*a* and 513*b* and the fulcrum portions 115*a* and 115*b* coming into contact with the concave portions 425*a* and 425*b*, respectively. In the switch device 1, the snap action mechanism 7 is constituted by the first driving body member 90, the second driving body 11, and the tensile spring 12 of the state of being assembled to the lower case 22.

Figure 11:
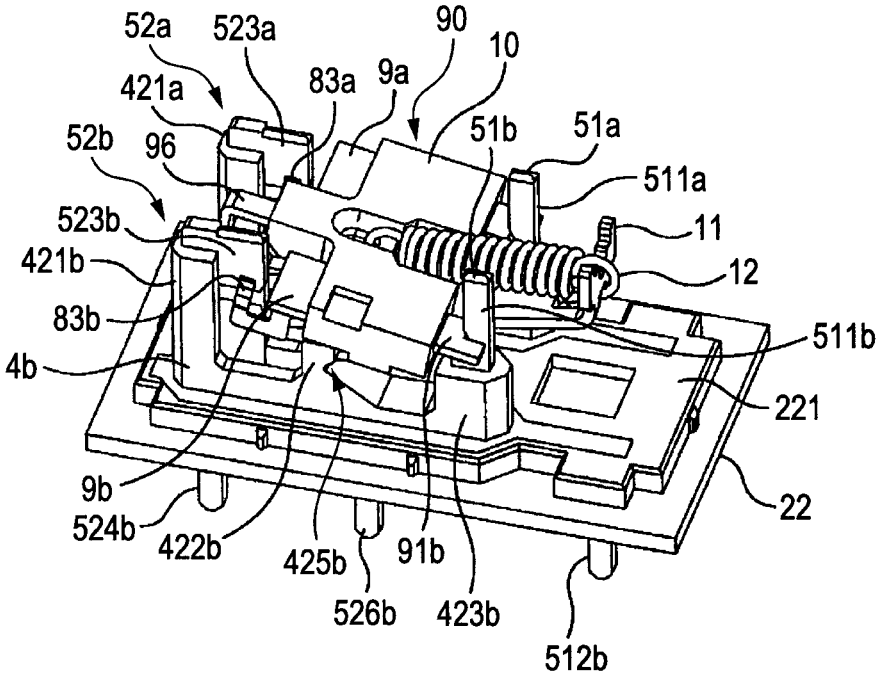
FIG. 11 is a perspective view of the lower case in which a snap action mechanism is assembled in the switch device according to the first embodiment.
Figure 12:
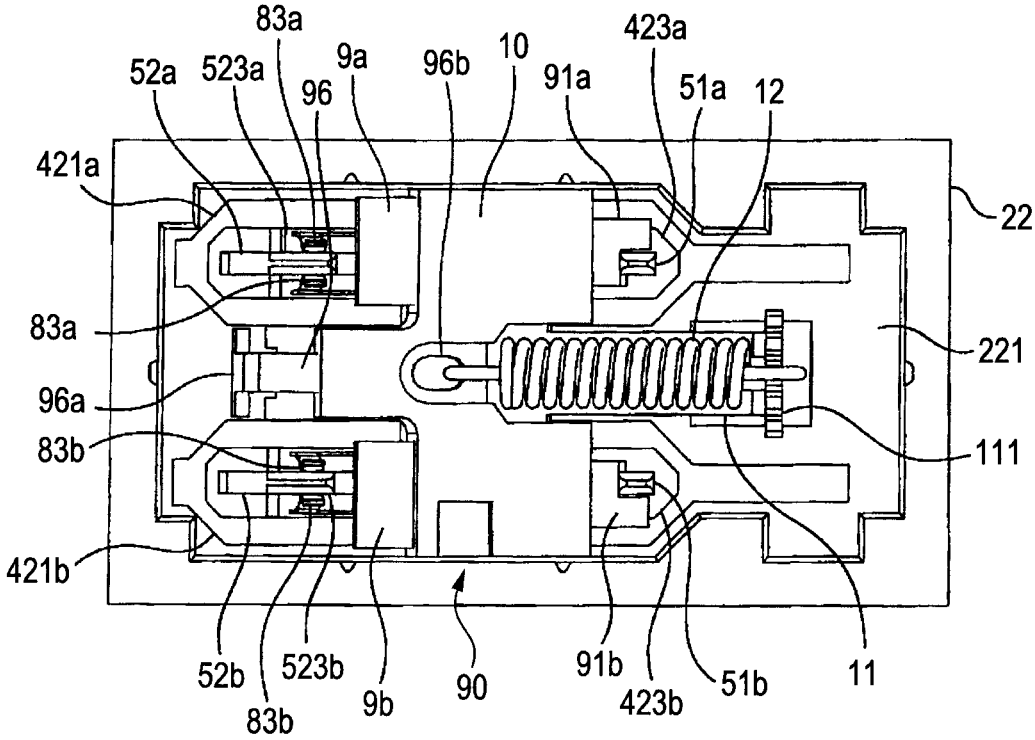
FIG. 12 is a plan view of the lower case in which a snap action mechanism is assembled in the switch device according to the first embodiment.
Figure 13A:
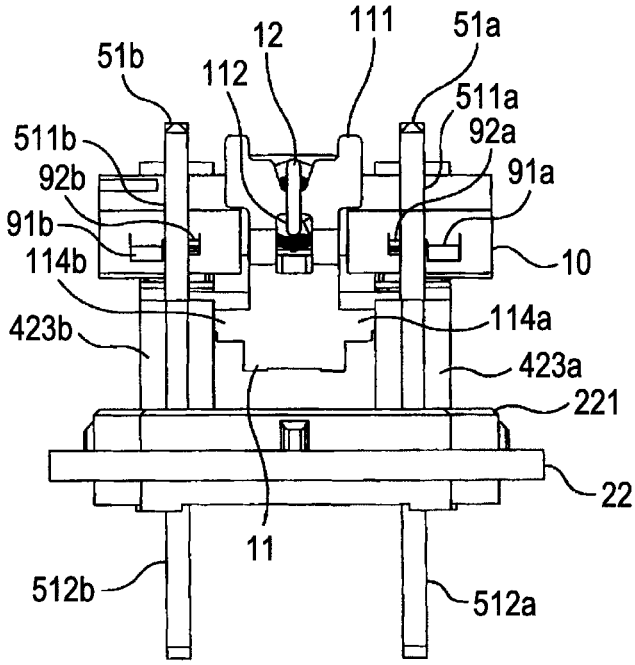
FIG. 13 is a side view of the lower case in which a snap action mechanism is assembled in the switch device according to the first embodiment.
Figure 13B:
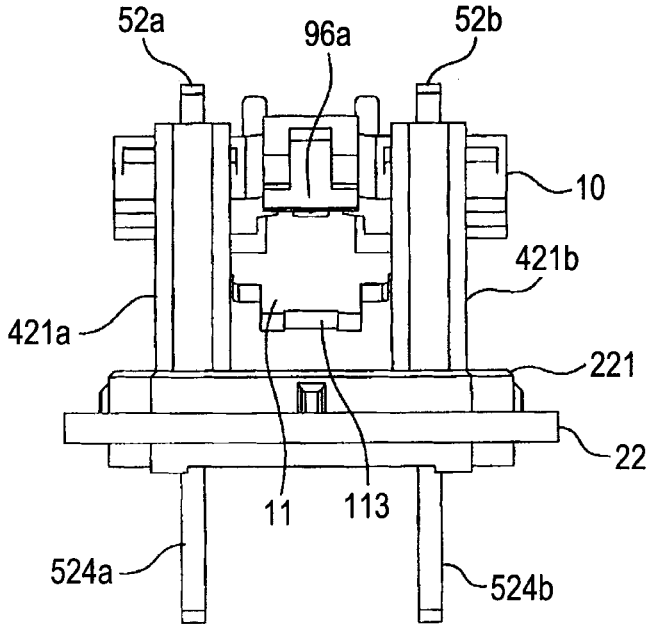

Herein, the configuration of the lower case 22, in which the snap action mechanism 7 is assembled in this manner, will be referenced to FIGS. 10, and 11 to 13. FIGS. 11 and 12 are a perspective view and a plan view of the lower case 22 in which the snap action mechanism 7 is assembled in the switch device 1 according to the first embodiment, respectively. FIG. 13 is a side view of the lower case 22 in which the snap action mechanism 7 is assembled in the switch device 1 according to the first embodiment. FIG. 13A shows a side surface when seen from a right side shown in FIG. 12, and FIG. 13B shows a side surface when seen from a left side shown in FIG. 12.

As shown in FIGS. 10 and 11, in the state of being assembled to the lower case 22, the first driving body member 90 is maintained in an upward state toward the left side shown in FIGS. 10 and 11, while the second driving body 11 is maintained in an upward state toward the right side shown in FIGS. 10 and 11. The movable contact points 8*a* and 8*b* disposed on the lower surface of the first driving body member 90 are extended to the left upside shown in FIGS. 10 and 11, and the contact point portions 83*a* and 83*b* are in sliding contact with the slide-contact portion 523*a* and 523*b* of the switch-over contact point 52*a* and 52*b*. In this case, as shown in FIG. 10, since the switch-over contact point 52*a* and 52*b* are disposed in positions which are more distant than the disposition positions of the fulcrum portions 115*a* and 115*b* of the second driving body 11 from the disposition positions of the fulcrum portions 92*a* and 92*b* of the first driving body member 90, the movement distance of the movable contact points 8*a* and 8*b* can be obtained more, whereby the contact point switch-over can be easily performed.

Furthermore, as shown in FIGS. 12 and 13, the fixed contact points 5*a* and 5*b* (the common contact points 51*a* and 51*b* and the switch-over contact points 52*a* and 52*b*) are provided side by side at a predetermined gap in the lower case 22. The first driving body member 90 disposes the first driving bodies 9*a* and 9*b* in positions corresponding to the fixed contact points 5*a* and 5*b* and disposes the movable contact points 8*a* and 8*b* in positions interposing the switch-over contact points 52*a* and 52*b* therebetween. Furthermore, the second driving body 11 is disposed so as to pass through the center portion in the lower side of the first driving body member 90, and is connected to the hole 96*b* provided in the reinforcing member 96 via the tensile spring 12.

Figure 14:
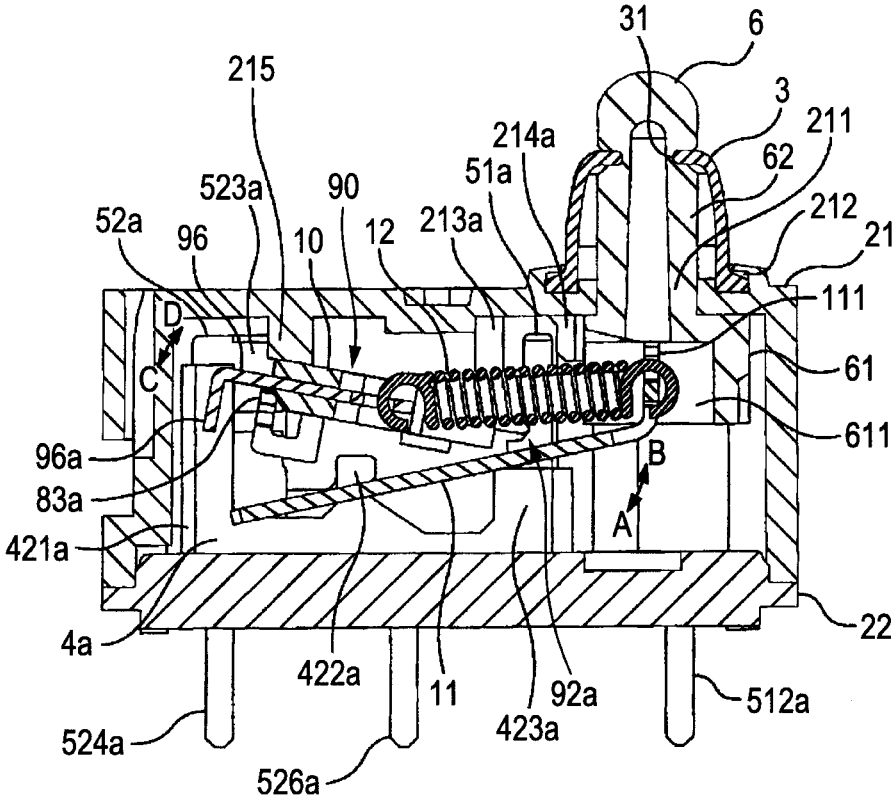
FIG. 14 is a side cross-sectional view for explaining an internal configuration of the switch device according to the first embodiment.

In the switch device 1 according to the first embodiment, with respect to the lower case 22 in which the snap action mechanism 7 is assembled in this manner, the upper case 21 is attached in a state in which the operation member 6 is disposed in the receiving member. Herein, the internal configuration of the switch device 1 according to the first embodiment will be described. FIG. 14 is a side cross-sectional view for explaining the internal configuration of the switch device 1 according to the first embodiment.

As shown in FIG. 14, the operation member 6 accommodates the pressing target portion 111 of the second driving body 11 by an accommodation portion 611 provided on the lower surface of a pressing portion 61, and is disposed in the receiving portion in the housing 2 in the state of inserting a shaft portion 62 into an opening portion 211. The cover 3, in which an outer edge portion provided in the lower end portion thereof is attached to a groove portion 212, is attached to the shaft portion 62 protruding from the opening portion 211. In addition, the upper end portion of the shaft portion 62 is protruded from the hole 31 of the cover 3.

Furthermore, in a predetermined position of an inner wall surface (a ceiling surface) of the upper case 21, protruding walls 213*a* and 214*a*, which are slightly protruded to the lower side, are provided. The protruding walls 213*a* and 214*a* are provided in a position accommodating the upper end portion of the common contact point 51*a*, and serves to suppress the collapse of the common contact point 51*a* due to the protruding wall 214*a* provided adjacently to and oppositely the common contact point 51*a* in a direction side to which the spring load of the tensile spring 12 is added. Since the front end of the common contact point 51*a* is accommodated by the protruding walls 213*b* and 214*b* provided in the inner wall surface of the housing in this manner, it is possible to suppress a situation in which the common contact point 51*a*, to which the spring load of the tensile spring 12 is added, collapses due to the heat generated due to the fixing work or the like of the terminal to the substrate. In addition, in FIG. 14, although it is not shown, on the inner wall surface (the ceiling surface) of the upper case 21, the protruding walls 213*a* and 214*a* are also provided in a position corresponding to the common contact point 51*b*. In the first embodiment, although the protruding walls 213*a* and 213*b* and the protruding walls 214*a* and 214*b* are provided, only the protruding walls 214*a* and 214*b* of the direction side, to which the spring load of the tensile spring 12 is added, may be provided.

In addition, in the inner wall surface (the ceiling surface) of the upper case 21, in a position of the second switch-over contact point 52*a* side further than the protruding wall 213*a*, a protruding wall 215 is provided. The protruding wall 215 is disposed in the upside of the connecting member 10 of the first driving body member 90, and acts to come into contact with the upper surface of the connecting member 10 to restrict the upward rotation of the first driving body member 90 due to the spring load of the tensile spring 12. Since the upward rotation of the first driving body member 90 can be restricted by the contact between the upper surface of the connecting member 10 and the protruding wall 215 in this manner, the first driving body member 90 can be rotated in a predetermined scope, whereby it is possible to prevent a situation in which the first driving body member 90 is rotated upward by more than a certain position and the movable contact point 8 or the like is damaged. In addition, the protruding wall 215 is provided so as to be situated between the movable contact points 8*a* and 8*b*, but two protruding walls 215 may be provided in positions corresponding to the movable contact points 8*a* and 8*b*, respectively.

In the switch device 1 according to the first embodiment, when receiving the pressing operation by the operation member 6 disposed on the pressing target portion 111, the pressing target portion 111 is pushed downward. Along with this, the second driving body 11 is rotated in an arrow A direction using the fulcrum portions 115*a* and 115*b* as the rotation fulcrum in resistance to the biasing force of the tensile spring 12. Meanwhile, when the pressing operation relative to the operation member 6 is released, the second driving body 11 is rotated in an arrow B direction using the fulcrum portions 115*a* and 115*b* as the rotation fulcrum depending on the biasing force of the tensile spring 12. In this state, the first driving body member 90 is rotated in arrows C and D directions using the fulcrum portions 92*a* and 92*b* as the rotation fulcrum depending on the rotation position of the second driving body 11.

Figure 15:
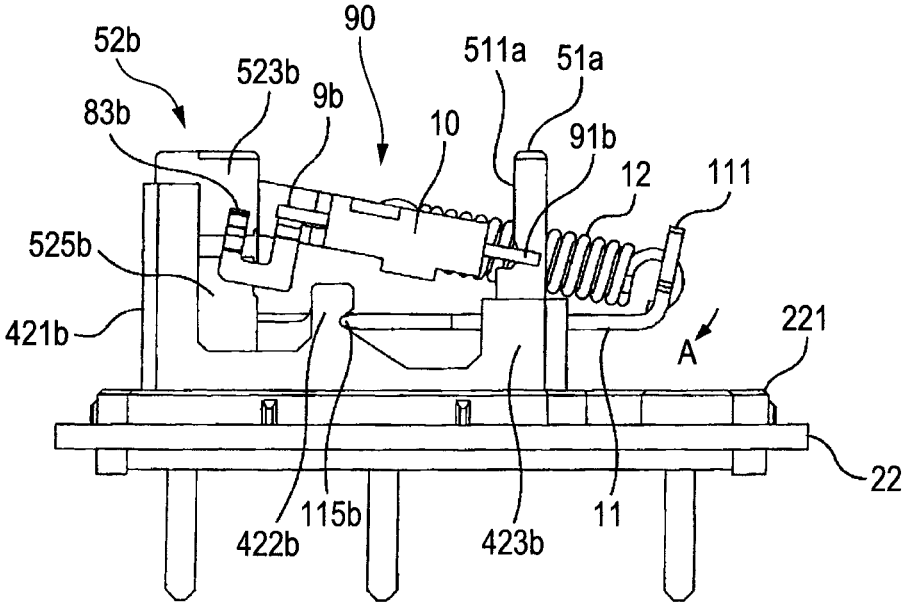
FIG. 15 is a side cross-sectional view for explaining a motion due to a pressing operation in the switch device according to the first embodiment.
Figure 16:
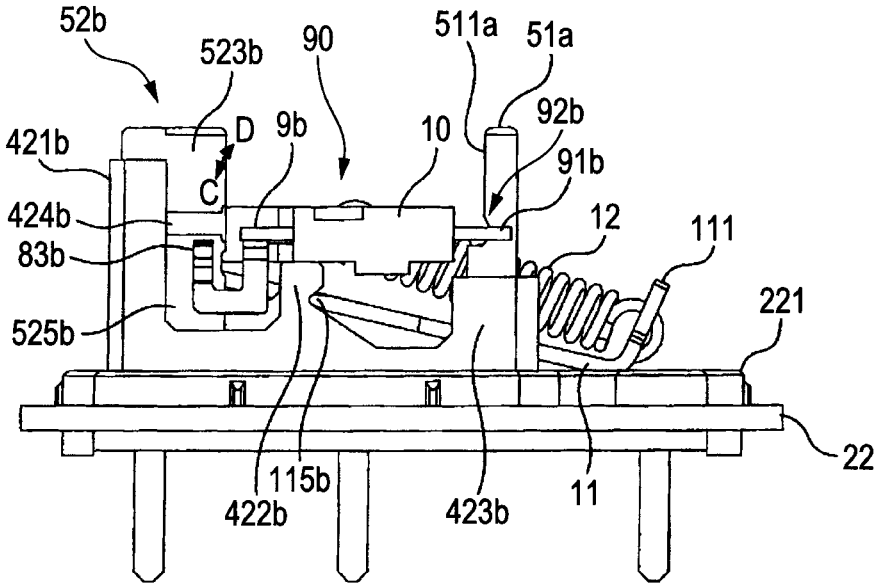
FIG. 16 is a side cross-sectional view for explaining a motion due to a pressing operation in the switch device according to the first embodiment.
Figure 17:
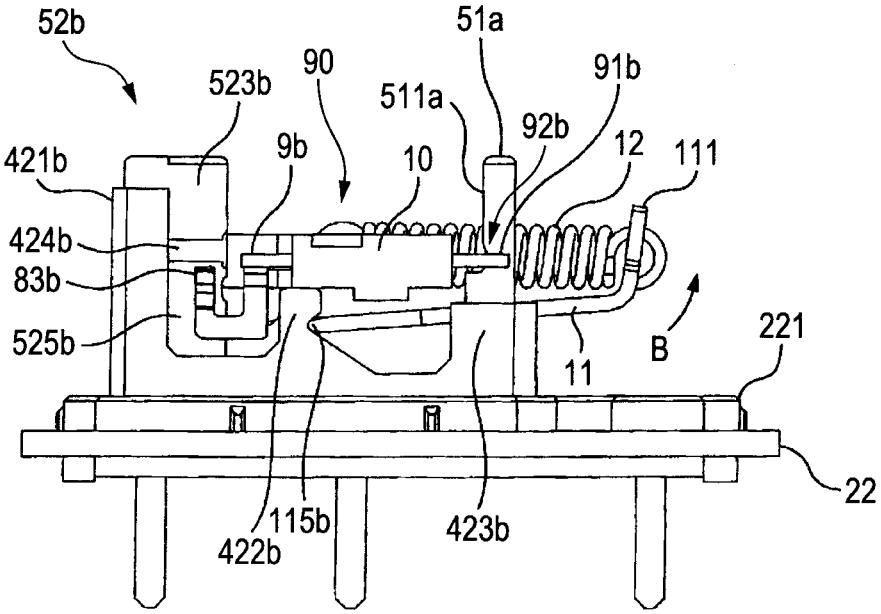
FIG. 17 is a side cross-sectional view for explaining a motion due to a pressing operation in the switch device according to the first embodiment.

Hereinafter, the motion accompanied by the pressing operation of the operation member 6 in the switch device 1 according to the first embodiment will be described. FIGS. 15 to 17 are side views for explaining the motion accompanied by the pressing operation in the switch device 1 according to the first embodiment. In addition, in FIGS. 15 to 17, for convenience of description, the upper case 21, the cover 3, and the operation member 6 are omitted.

In a state in which the pressing operation is not performed on the operation member 6, the switch device 1 is in the states shown in FIGS. 10 and 14, the movable contact points 8*a* and 8*b* are extended to the left upside shown in FIGS. 10 and 11, the contact point portions 83*a* and 83*b* are in sliding contact with each other with the slide-contact point portions 523*a* and 523*b* of the switch-over contact points 52*a* and 52*b* interposed therebetween. In this case, the circuit having the first switch-over contact points 521*a* and 521*b* as the normal close contact point and the common contact points 51*a* and 51*b* is in a connected state.

When the pressing operation is received by the operation member 6 and the pressing target portion 111 is pressed to the lower side, as shown in FIG. 15, the second driving body 11 is rotated in an arrow A direction using the fulcrum portions 115*a* and 115*b* as the rotation fulcrum. However, when the second driving body 11 is rotated up to a predetermined limitation position, the first driving body member 90 is stopped in an initial position (a position shown in FIGS. 10 and 14). Thus, the contact point portions 83*a* and the 83*b* of the movable contact points 8*a* and 8*b* are still in sliding contact with the slide-contact portion 523*a* and 523*b*. In addition, in FIG. 15, a state of the second driving body 11 immediately before reaching a predetermined limitation position is shown.

Moreover, when the second driving body 11 is rotated up to a predetermined limitation position, the direction of the biasing force of the tensile spring 12 acting on the first driving body member 90 and the second driving body 11 is reversed, the first driving body member 90 is dragged to the lower side, and as shown in FIG. 16, the first driving body member 90 is rotated in an arrow C direction using the fulcrum portions 92*a* and 92*b* as the rotation fulcrum in an instant. In this case, the contact point portions 83*a* and 83*b* of the movable contact points 8*a* and 8*b* pass through the insulation piece 424*b* and come into sliding contact with the slide-contact point portions 525*a* and 525*b*. As a result, the circuit having the second switch-over contact points 522*a* and 522*b* as the normal open contact point and the common contact points 51*a* and 51*b* is converted to the connected state. In this case, since the movable contact points 8*a* and 8*b* are provided in the first driving bodies 9*a* and 9*b* connected to the connecting member 10, the movable contact points 8*a* and 8*b* slide on the switch-over contact points 52*a* and 52*b* at substantially the same timing and slide on the slide-contact point portions 525*a* and 525*b*.

Meanwhile, when the pressing operation of the operation member 6 is released, as shown in FIG. 17, the second driving body 11 is rotated in an arrow B direction using the fulcrum portions 115*a* and 115*b* as the rotation fulcrum depending on the biasing force of the tensile spring 12. However, until the second driving body 11 is rotated up to a predetermined limitation position, the first driving body member 90 is still stopped in a position shown in FIG. 16. Thus, the contact point portions 83*a* and 83*b* of the movable contact points 8*a* and 8*b* are maintained state in which sliding contact with the slide-contact point portions 525*a* and 525*b*. In addition, FIG. 17 shows a state of the second driving body 11 immediately before reaching a predetermined limitation position.

Moreover, when the second driving body 11 is rotated up to a predetermined limitation position, a direction of the biasing force of the tensile spring 12 acting on the first driving body member 90 and the second driving body 11 is reversed, the first driving body member 90 is dragged to the upside via the tensile spring 12, the first driving body member 90 is rotated in an arrow D direction using the fulcrum portions 92*a* and 92*b* as the rotation fulcrum in an instant, and returns to the initial position (see FIG. 14). In this case, the contact point portions 83*a* and 83*b* of the movable contact points 8*a* and 8*b* pass through the insulation piece 424*b* and are in sliding contact with the slide-contact point portions 525*a* and 525*b*. As a result, the circuit having the first switch-over contact points 521*a* and 521*b* as the normal close contact point and the common contact points 51*a* and 51*b* are converted to a connected state. Also, in this case, in the practice, the movable contact points 8*a* and 8*b* slide on the switch-over contact points 52*a* and 52*b* at substantially the same timing and are brought into sliding contact with the slide-contact point portions 523*a* and 523*b*.

As described above, according to the switch device 1 according to the first embodiment, since the switch device 1 includes the snap action mechanism 7 driving the first driving body member 90 with the movable contact points 8*a* and 8*b* provided therein, when the operation member 6 is pressed to a predetermined limitation position, it is possible to drive the movable contact points 8*a* and 8*b* provided in the first driving bodies 9*a* and 9*b*, which are integrally connected to each other by the biasing force of the tensile spring 12, in an instant. Thus, even when a plurality of circuits is synchronized and switched, it is possible to reduce the irregularity of the synchronization timing of the circuit switch-over.

Furthermore, in the switch device 1 according to the first embodiment, an end of the tensile spring 12 is attached to the hole 96*b* provided in the reinforcing portion 96 exposed from the connecting member 10, whereby the occurrence of a situation, in which the connecting member 10 is deformed by the biasing force of the tensile spring 12, is made difficult. Thus, it is possible to secure the position accuracy of the movable contact points 8*a* and 8*b* provided in the first driving bodies 9*a* and 9*b*, which are integrally connected to each other, to switch the plurality of circuits at a suitable timing.

In addition, in the switch device 1 according to the first embodiment, the attachment portion of the movable contact points 8*a* and 8*b* to the first driving bodies 9*a* and 9*b* is embedded in the connecting member 10 and the movable contact points 8*a* and 8*b* are firmly fixed to the first driving bodies 9*a* and 9*b*, which can prevent a situation in which the movable contact points 8*a* and 8*b* are missed or deviated. Thus, it is possible to secure the position accuracy of the movable contact points 8*a* and 8*b* provided in the first driving bodies 9*a* and 9*b*, which are integrally connected to each other, to switch the plurality of circuits at a suitable timing.

In addition, in the switch device 1 according to the first embodiment, since the tensile spring 12 is attached to the second driving body 11 in a position between the first driving body 9*a* and the first driving body 9*b*, the movable contact points 8*a* and 8*b* provided in the first driving bodies 9*a* and 9*b* can be driven by the biasing force by the same tensile spring 12, whereby it is possible to further reduce the irregularity of the synchronization timing of the circuit switch-over.

Second Embodiment

Figure 19:
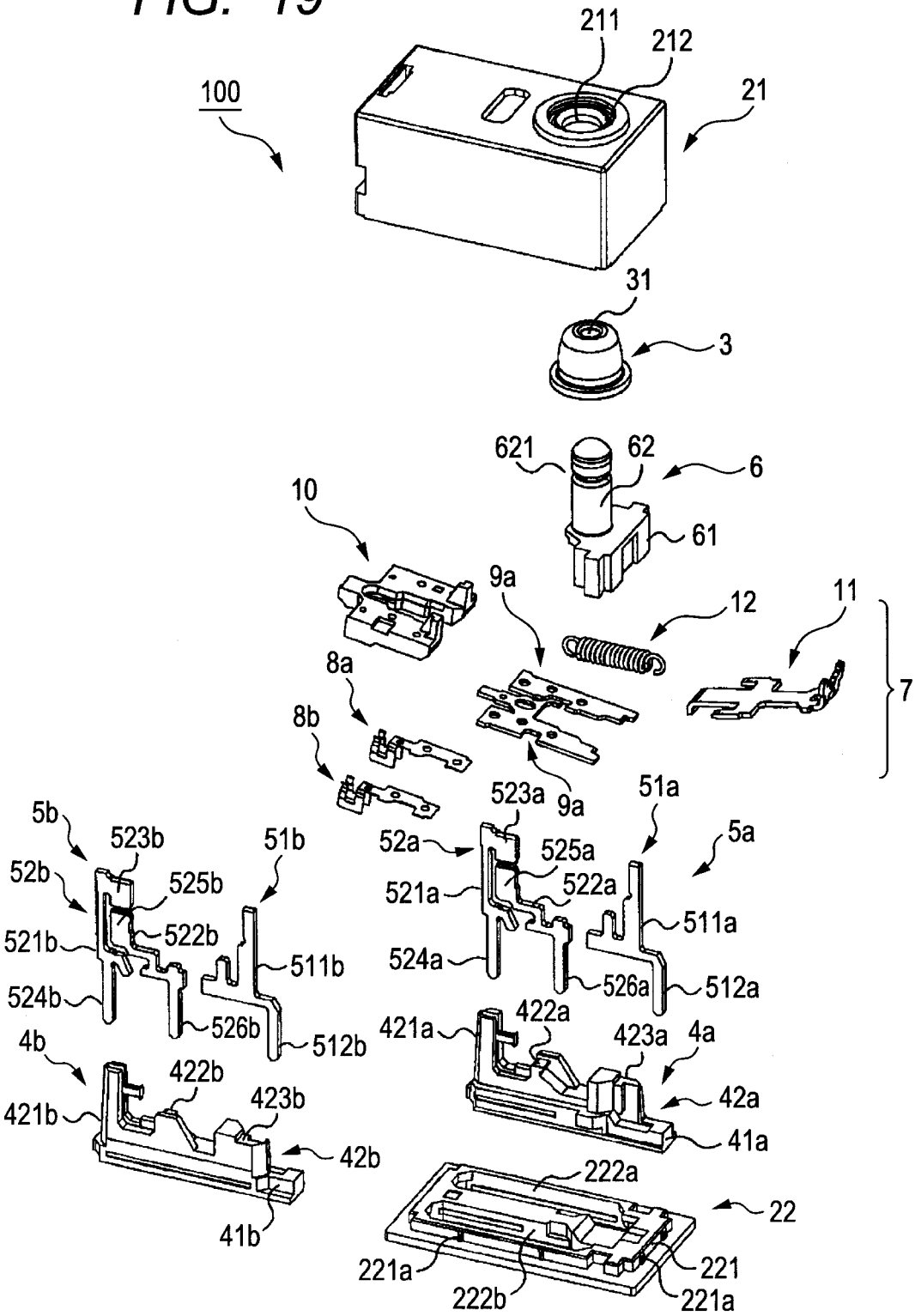
FIG. 19 is an exploded perspective view of a switch device according to a second embodiment of the invention.

FIG. 19 is an exploded perspective view of a switch device 100 according to a second embodiment of the invention. In addition, in the switch device 100 shown in FIG. 19, configurations common to the switch device 1 according to the first embodiment will be denoted by the same reference numerals and descriptions thereof will be omitted. As shown in FIG. 19, similarly to the switch device 1 according to the first embodiment, the switch device 100 according to the second embodiment includes a housing 2, a cover 3, a supporter 4, a fixed contact point 5, an operation member 6, and a snap action mechanism 7.

In regard to a configuration when the switch device 100 according to the second embodiment is assembled, similarly to the switch device 1 according to the first embodiment, a part of the operation member 6 described later is protruded from a part of the upper surface of a box-shaped housing 2 and a pressing operation from an operator or the like is received by the protruding portion. The cover 3 for preventing foreign matters such as dust or water from entering the housing 2 is attached to a part of the operation member 6 protruding from the housing 2 (see FIG. 1).

In the switch device 100 according to the second embodiment, generally, the configurations of the supporters 4*a* and 4*b*, the fixed contact point 5 (second switch-over contact points 522*a* and 522*b*) and the first driving body member 90 are different from those of the switch device 1 according to the first embodiment. Hereinafter, the configuration of the principal parts of the switch device 100 according to the second embodiment will be described based on a difference from the switch device 1 according to the first embodiment.

Figure 20:
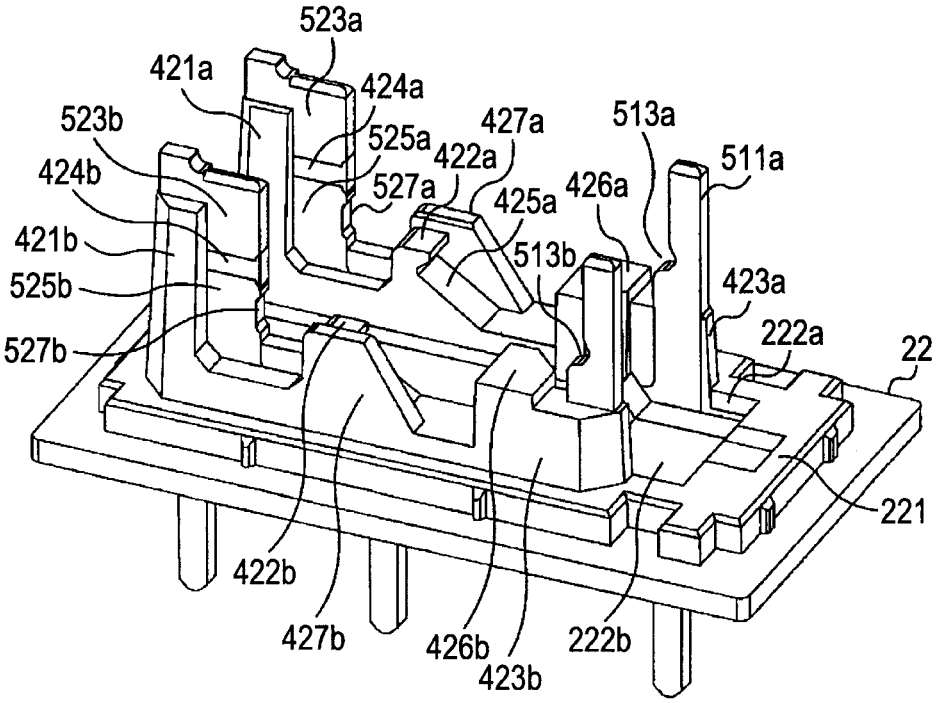
FIG. 20 is a perspective view of a lower case in which a supporter and a fixed contact point are fixed in the switch device according to the second embodiment.

FIG. 20 is a perspective view of the lower case 22 in which the supporter 4 and the fixed contact point 5 in the switch device 100 according to the second embodiment are fixed. FIGS. 21 and 22 are perspective views of the first driving body member 90 included in the switch device 100 according to the second embodiment. In addition, in FIG. 21, the connecting member 10 is omitted from the first driving body member 90. FIG. 23 is a perspective view of the second driving body 11 included in the switch device 100 according to the second embodiment. In addition, in FIGS. 20 to 23, the configurations common to those shown in FIGS. 3 to 6 are denoted by the same reference numerals and the descriptions thereof will be omitted.

As shown in FIG. 20, the supporters 4*a* and 4*b* according to the second embodiment is different from the supporter 4*a* and 4*b* according to the first embodiment in that support portions 426*a* and 426*b*, which support the first mounting portion of the second driving body 11 described later, respectively, are mounted on the protruding pieces 423*a* and 423*b*. Furthermore, the supporters 4*a* and 4*b* according to the second embodiment is different from the supporters 4*a* and 4*b* according to the first embodiment in that the upper surfaces of the protruding pieces 422*a* and 422*b* function as support portions which support a second mounting portion of the second driving body 11 described later. In addition, the supporters 4*a* and 4*b* according to the second embodiment are different from the supporters 4*a* and 4*b* according to the first embodiment in that, at the outside (lateral side) of the protruding pieces 422*a* and 422*b*, support wall portions 427*a* and 427*b* are provided which support the lower surface of the connecting member 10 of the first driving body member 90 upon assembling the snap action mechanism 7.

The support wall portions 427*a* and 427*b* function to guide portions 10*c* and 10*d* of the connecting member 10 described later upon assembling the snap action mechanism 7 and serve to restrict the rotation of the first driving body member 90 to the lower side due to the spring load of the tensile spring 12. Since it is possible to restrict the rotation of the first driving body member 90 to the lower side by the contact between the lower surface of the connecting member 10 and the support wall portions 427*a* and 427*b*, the first driving body member 90 can be rotated in a predetermined scope, whereby it is possible to prevent a situation in which the first driving body member 90 is rotated to the lower side by more than a predetermined position and the movable contact point 8 or the like is damaged. In addition, an addition of a shock absorbing material on the upper surfaces of the support portions 426*a* and 426*b* is desirable as an embodiment.

Furthermore, the fixed contact point 5 (second switch-over contact points 522*a* and 522*b*) according to the second embodiment is different from the slide-contact point portions 525*a* and 525*b* according to the first embodiment in that, on the side surfaces of the slide-contact point portions 525*a* and 525*b* exposed from the protruding pieces 421*a* and 421*b* to the protruding pieces 422*a* and 422*b*, concave portions 527*a* and 527*b* as allowance portions which accommodate the front end portions of the fulcrum portions 115*a* and 115*b* of the second driving body 11 upon assembling the snap action mechanism 7 are provided.

Figure 21A:
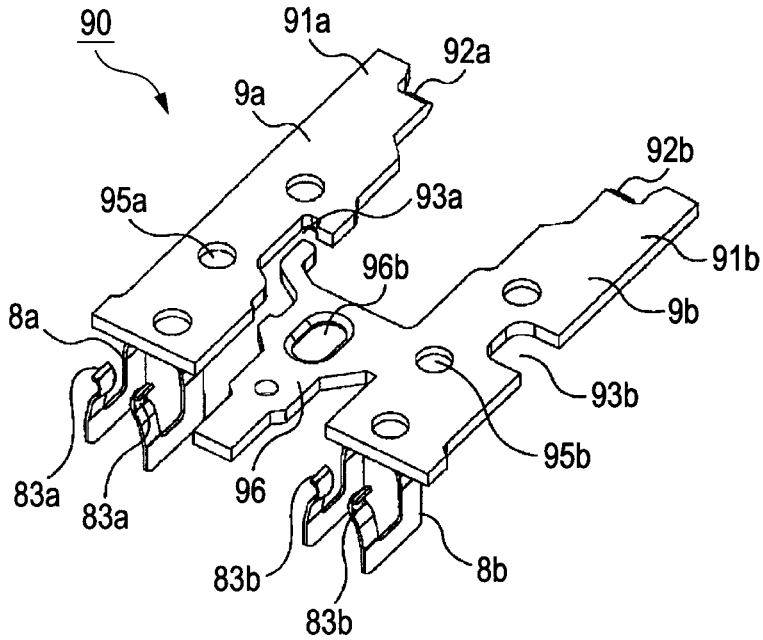
FIG. 21 is a perspective view of a first driving body member included in the switch device according to the second embodiment.
Figure 21B:
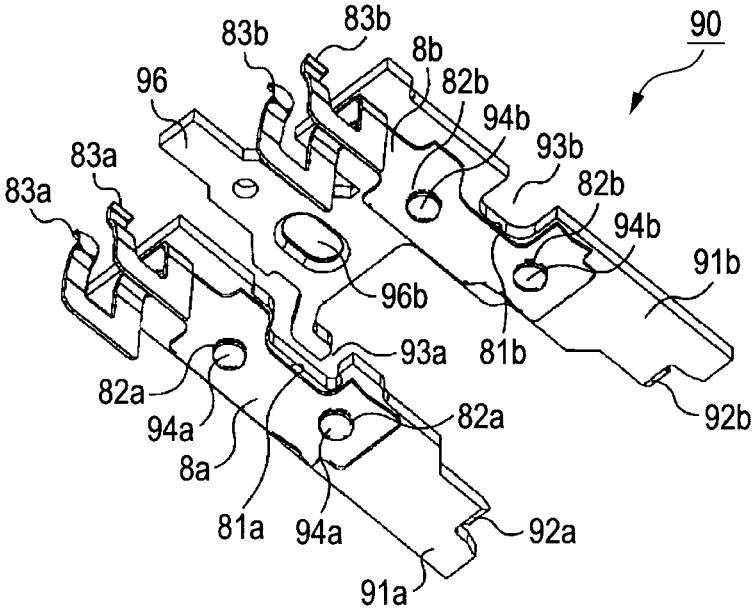

The first driving body member 90 according to the second embodiment is different from the first driving body member 90 according to the first embodiment in that, as shown in FIGS. 21A and 21B, the engagement piece 96*a* is not provided in the reinforcing portion 96, and the front end portion thereof is extended to the position that is nearly the same as the contact point portions 83*a* and 83*b* of the movable contact points 8*a* and 8*b*. In addition, although the first driving bodies 9*a* and 9*b* according to the second embodiment are different from the first driving bodies 9*a* and 9*b* according to the first embodiment, such as notch portions 93*a* and 93*b*, there is no substantial difference.

Figure 22A:
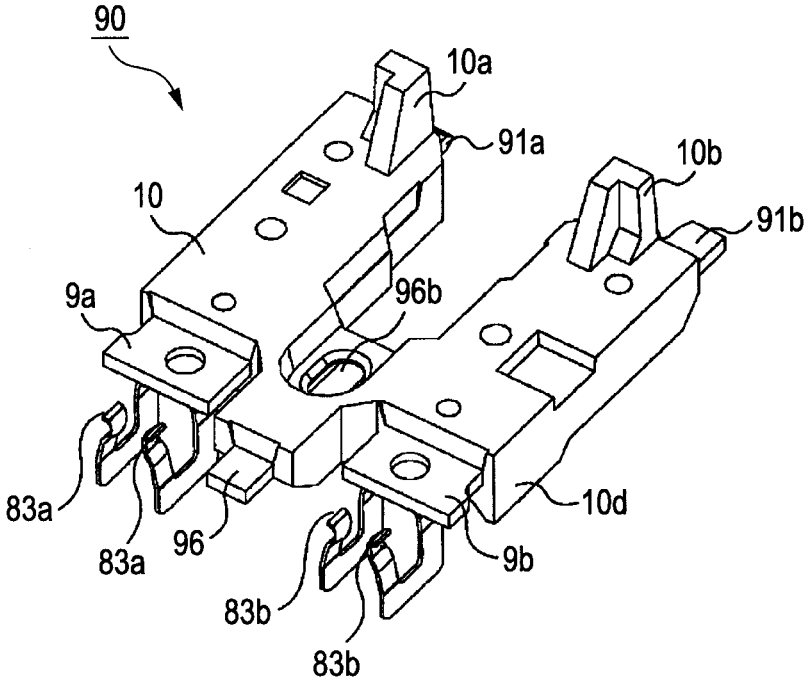
FIG. 22 is a perspective view of a first driving body member included in the switch device according to the second embodiment.
Figure 23:
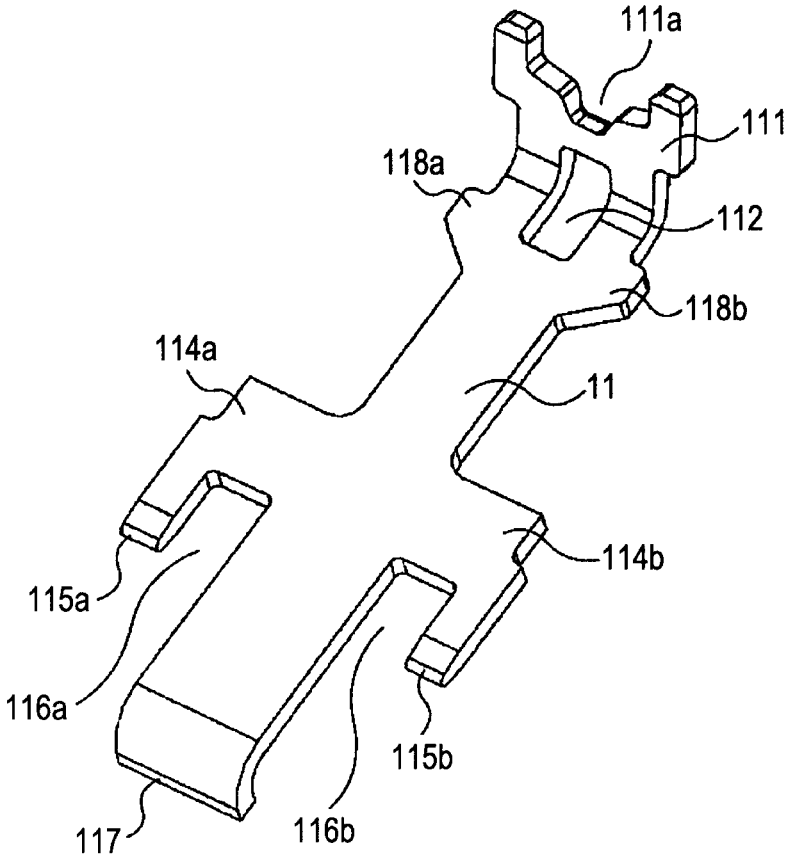
FIG. 23 is a perspective view of a second driving body member included in the switch device according to the second embodiment.

Furthermore, the first driving body member 90 according to the second embodiment is different from the first driving body member 90 according to the first embodiment in that, as shown in FIG. 22A, contact pieces 10*a* and 10*b* as rotation restriction portions are provided on the end portion upper surface of the protruding pieces 91*a* and 91*b* side in the connecting member 10. The contact pieces 10*a* and 10*b* serve to restrict the rotation due to the spring load of the tensile spring 12 by the contact with the contact portions 511*a* and 511*b* of the common contact points 51*a* and 51*b* upon assembling the snap action mechanism 7. In this manner, in the switch device 100 according to the second embodiment, the rotation of the first driving body member 90 can be restricted by the contact between the contact pieces 10*a* and 10*b* of the first driving body member 90 and the common contact points 51*a* and 51*b*. Thus, it is possible to maintain the first driving body member 90 and the second driving body 11 in the process of assembling work in a stable state and to improve work efficiency.

Figure 22B:
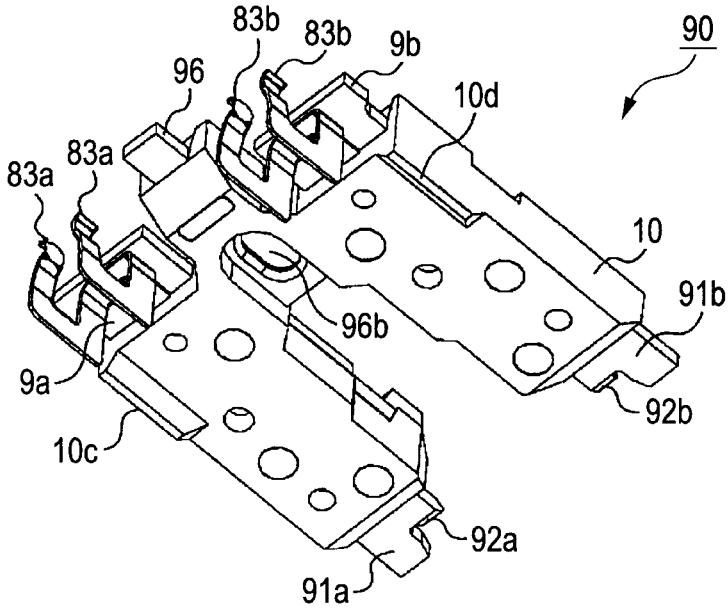

In addition, the first driving body member 90 according to the second embodiment is different from the first driving body member 90 according to the first embodiment in that guide portions 10*c* and 10*d* are provided in the end portion lower surface of the contact point portions 83*a* and 83*b* sides of the movable contact points 8*a* and 8*b* in the connecting member 10 as shown in FIG. 22*b*. The guide portions 10*c* and 10*d* serve to come into sliding contact with the support wall portions 427*a* and 427*b* to guide the first driving body member 90 upon assembling the snap action mechanism 7.

Furthermore, the second driving body 11 according to the second embodiment is different from the first driving body member 90 according to the first embodiment in that the protruding portions 114*a* and 114*b* of the second driving body 11 have shapes bent at the lateral side end portion thereof and fulcrum portions 115*a* and 115*b* are provided in the front end of the bent portion as shown in FIG. 22*b*. Between the fulcrum portions 115*a* and 115*b* and a main body of the second driving body 11, certain space portions 116*a* and 116*b* are formed. The space portions 116*a* and 116*b* serve to accommodate the inner contact point portions 83*a* and 83*b* of the movable contact points 8*a* and 8*b* upon assembling the snap action mechanism 7.

In addition, in the second driving body 11 according to the second embodiment, a part of the protruding portions 114*a* and 114*b* functions as a second mounting portion of the second driving body 11 upon assembling the snap action mechanism 7. In this manner, since, in the switch device 100 according to the second embodiment, the fulcrum portions 115*a* and 115*b* are formed in a part of the second mounting portion capable of mounting the second driving body 11, it is possible to include a function as the fulcrum portions 115*a* and 115*b* in the second mounting portion to simplify the configuration of the second driving body 11.

In addition, the second driving body 11 according to the second embodiment is different from the first driving body member 90 according to the first embodiment in that the engagement concave portion 113 is not provided in the second driving body 11, but a contact piece 117 protruding downward is provided in place of the engagement concave portion 113. The contact piece 117 serves as a rotation restriction portion that comes into contact with the lower case 22 of the housing 2 to restrict the rotation due to the spring load of the tensile spring 12 upon assembling the snap action mechanism 7. In this manner, in the switch device 100 according to the second embodiment, since the rotation of the second driving body 11 can be restricted by the contact between the contact piece 117 of the second driving body 11 and the lower case 22. Thus, it is possible to maintain the first driving body member 90 and the second driving body 11 in the process of assembling work in a stable state and to improve the work efficiency of the assembling work.

In addition, in the second driving body 11 according to the second embodiment, protruding pieces 118*a* and 118*b* protruding to the lateral side are provided near the opening portion 112 of the second driving body 11. The protruding pieces 118*a* and 118*b* have a shape slightly protruding from the pressing target portion 111 to the lateral side, and function as the first mounting portion of the second driving body 11. In the switch device 100 according to the second embodiment, since the mounting portion is constituted by the first mounting portions of the common contact points 51*a* and 51*b* side and the second mounting portion of the switch-over contact points 52*a* and 52*b*, it is possible to stably mount the mounting portion on the upper surfaces of the support portions 426*a* and 426*b* of the supporters 4*a* and 4*b* and the protruding pieces 422*a* and 422*b*. Particularly, since the protruding pieces 114*a* and 114*b* constituting the second mounting portion are formed to be longer than the first mounting portion in a direction from the common contact points 51*a* and 51*b* to the switch-over contact points 52*a* and 52*b*, it is possible to stably move the second driving body 11 in a slide manner while maintaining the state of supporting the second driving body 11 on the upper surfaces of the support portions 426*a* and 426*b* of the supporters 4*a* and 4*b* and the protruding pieces 422*a* and 422*b*.

In the switch device 100 according to the second embodiment, the snap action mechanism is assembled by assembling the first driving body member 90 and the second driving body 11 having the difference from the first embodiment to the lower case 22 of the state shown in FIG. 20. The switch device 100 according to the second embodiment is different from the first embodiment, in which the first driving body member 90 and the second driving body 11 are integrated and then are assembled to the lower case 22, in that the first driving body member 90 and the second driving body 11 are assembled to the lower case 22, respectively.

Hereinafter, in the switch device 100 according to the second embodiment, the motion upon assembling the first driving body member 90 and the second driving body 11 to the lower case 22 of the state shown in FIG. 20 will be described. FIGS. 24 to 27 are side views (A) and side cross-sectional views (B) that show a process upon assembling the first driving body member 90 and the second driving body 11 to the lower case 22 of the state shown in FIG. 20.

Figure 24A:
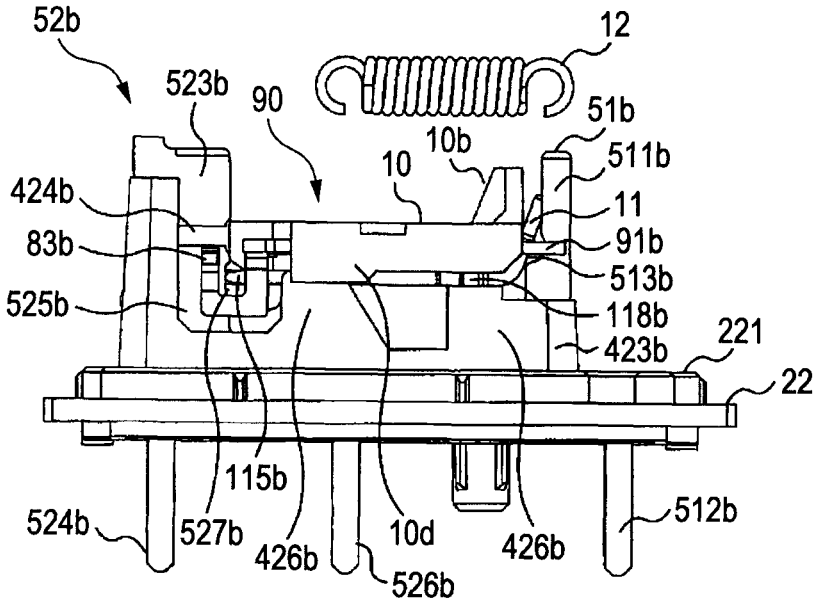
FIGS. 24A and 24B are a side view and a side cross-sectional view which show a process upon assembling the first driving body member and the second driving body that are integrated with the lower case of the state shown in FIG. 20.
Figure 24B:
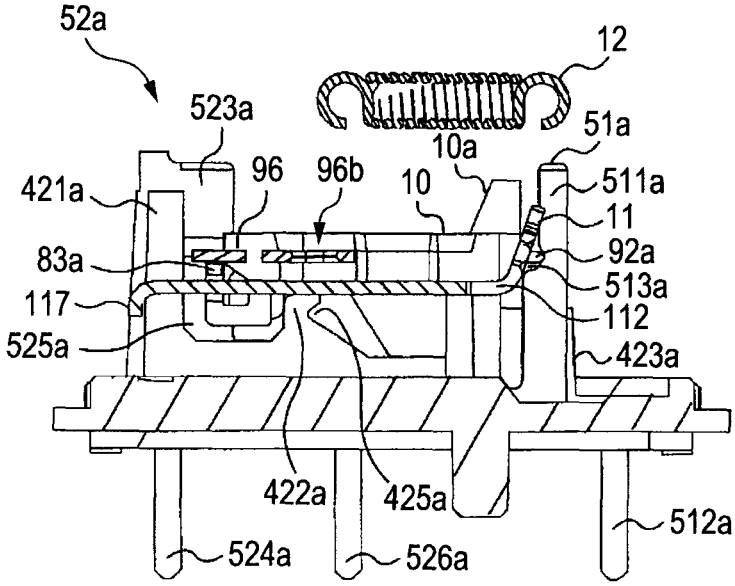

When the first driving body member 90 and the second driving body 11 are assembled to the lower case 22 of the state shown in FIG. 20, firstly, as shown in FIG. 24, the first driving body member 90 is mounted on the supporters 4*a* and 4*b* and the second driving body 11 is mounted. In this case, in the second driving body 11, the protruding pieces 114*a* and 114*b*, which function as the second mounting portion, are mounted on the upper surfaces of the protruding pieces 422*a* and 422*b*, and protruding pieces 118*a* and 118*b*, which function as the first mounting portion, are mounted on the upper surfaces of the support portions 426*a* and 426*b*. Furthermore, the second driving body 11 is disposed in a state in which the front ends of the fulcrum portions 115*a* and 115*b* are accommodated in the concave portions 527*a* and 527*b* as allowance portions formed in the second switch-over contact points 522*a* and 522*b*. At this time, the space portions 116*a* and 116*b* of the second driving body 11 accommodate the inner contact point portions 83*a* and 83*b* of the movable contact points 8*a* and 8*b*.

Meanwhile, the first driving body member 90 is mounted in parallel to the second driving body 11 mounted on the lower case 22 in this manner. In this case, the first driving body member 90 is disposed in a state in which the fulcrum portions 92*a* and 92*b* are accommodated in the concave portions 513*a* and 513*b* formed in the common contact points 51*a* and 51*b*, and the guide portions 10*c* and 10*d* are disposed outside the support portions 426*a* and 426*b*.

Moreover, the tensile spring 12 is attached to the first driving body member 90 and the second driving body 11 disposed in this manner. Specifically, an end of the tensile spring 12 is engaged with the hole 96*b* of the reinforcing member 96 constituting the first driving body member 90, and the other end of the tensile spring 12 is engaged with the opening portion 112 of the second driving body 11. In this case, the tensile spring 12 is attached from upper side of the first driving body member 90 which is overlapped by the second driving body 11. That is, since the tensile spring 12 is attached in a state in which the first driving body member 90 and the second driving body 11 are parallel to each other, the tensile spring 12 can be attached without separately preparing a jig or the like that maintains them in a predetermined state, whereby it is possible to improve the work efficiency of the assembling work of the snap action mechanism 7. In addition, FIG. 24 shows a state before attaching a tensile spring 12.

Figure 25A:
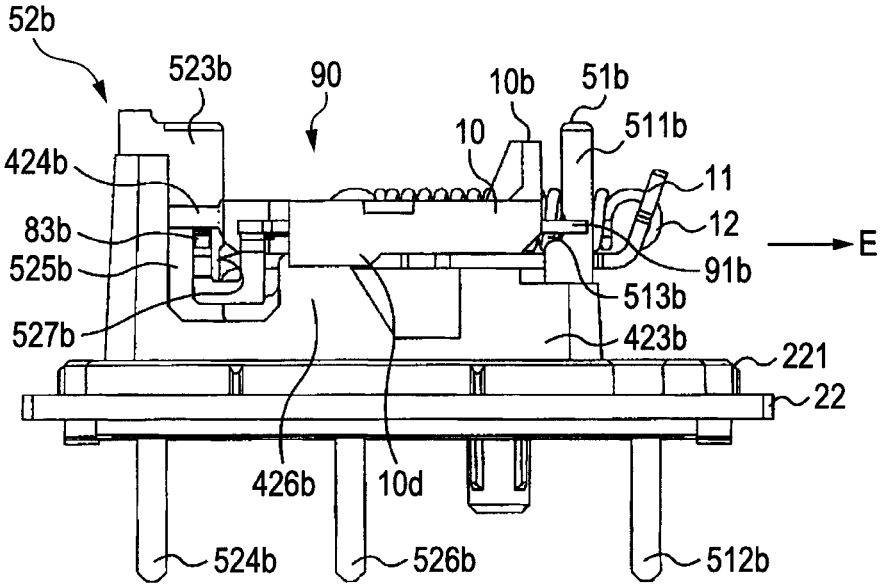
FIGS. 25A and 25B are a side view and a side cross-sectional view which show a process upon assembling the first driving body member and the second driving body that are integrated with the lower case of the state shown in FIG. 20.
Figure 25B:
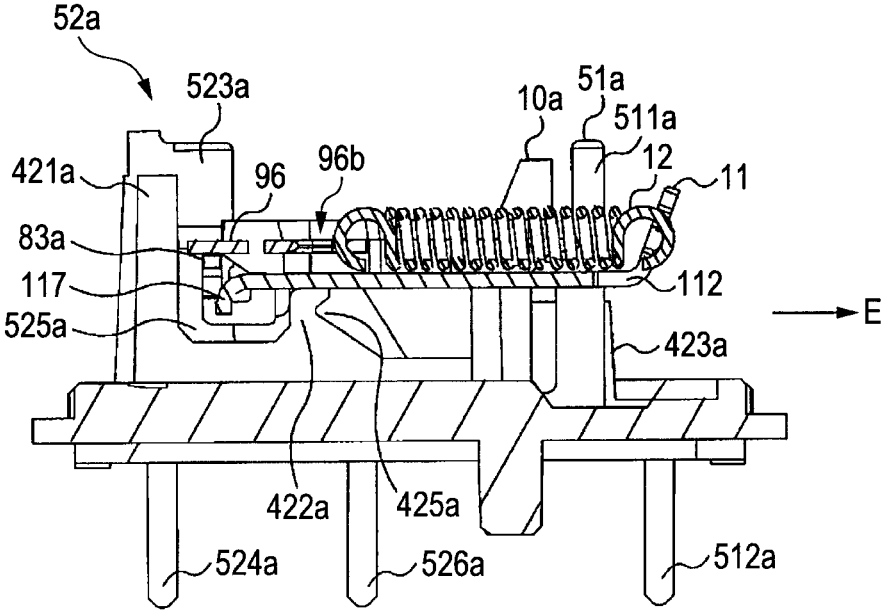

After attaching the tensile spring 12 to the first driving body member 90 and the second driving body 11 of the state shown in FIG. 24, as shown in FIG. 25, the second driving body 11 is pushed to the common contact points 51*a* and 51*b* side, that is, in an arrow E direction shown in FIG. 25 in resistance to the biasing force of the tensile ring 12, while pushing the first driving body member 90 downward by hand. In this case, since the fulcrum portions 92*a* and 92*b* are accommodated in the concave portions 513*a* and 513*b*, the first driving body member 90 maintains the state shown in FIG. 24, and only the second driving body 11 is moved. At this time, the second driving body 11 is moved in a state in which the protruding pieces 114*a* and 114*b* are in sliding contact with the upper surfaces of the protruding pieces 422*a* and 422*b*. When the second driving body 11 is moved in the arrow E direction, the fulcrum portions 115*a* and 115*b* come out of the concave portions 527*a* and 527*b* and are retreated to the right side shown in FIG. 25.

Moreover, after the protruding pieces 114*a* and 114*b* are moved from the upper surfaces of the protruding pieces 422*a* and 422*b* to the position reaching to the right side shown in FIG. 25, the protruding pieces 114*a* and 114*b* move the end portion of the contact piece 117 of the second driving body 11 to the lower side. At this time, the end portion of the contact piece 117 of the second driving body 11 is moved to the lower side, while slightly moving the second driving body 11 to the left side shown in FIG. 25 depending on the biasing force of the tensile spring 12. As a result, the fulcrum portions 115*a* and 115*b* of the second driving body 11 are disposed in the concave portions 425*a* and 425*b* of the protruding pieces 422*a* and 422*b* (see FIG. 26B). At this time, the right side end portion of the second driving body 11 is slightly extended upward, and the second driving body 11 is extended upward farther than the right side end portion of the tensile spring 12.

Figure 26A:
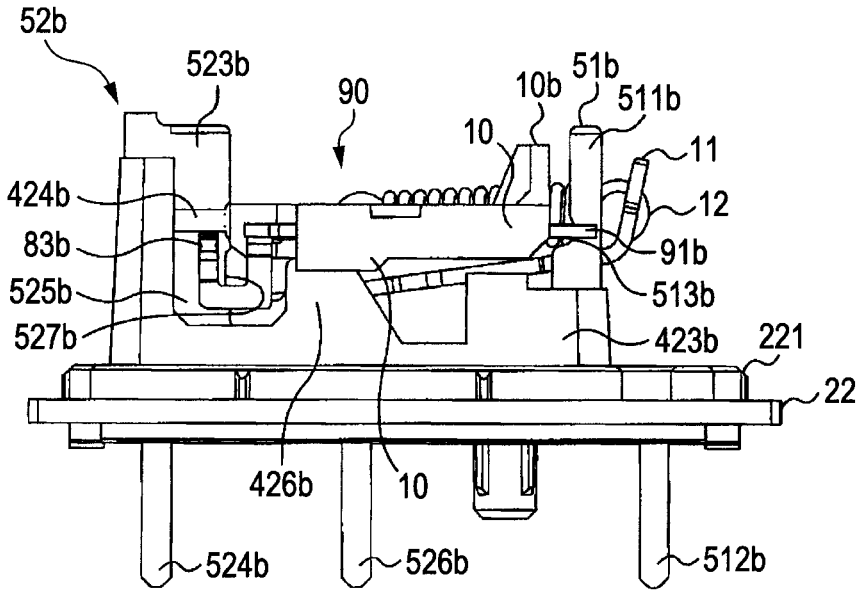
FIGS. 26A and 26B are a side view and a side cross-sectional view which show a process upon assembling the first driving body member and the second driving body that are integrated with the lower case of the state shown in FIG. 20.
Figure 26B:
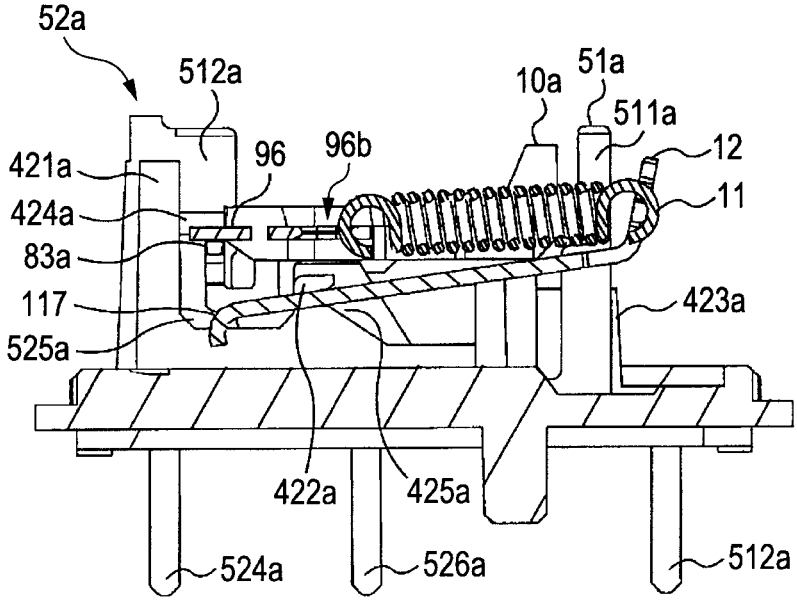
Figure 27A:
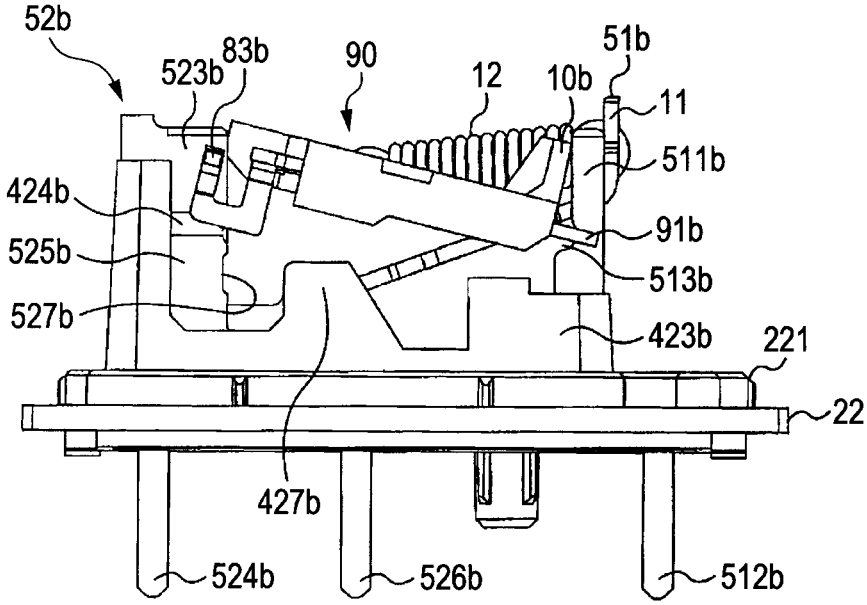
FIGS. 27A and 27B are a side view and a side cross-sectional view which show a process upon assembling the first driving body member and the second driving body that are integrated with the lower case of the state shown in FIG. 20.
Figure 27B:
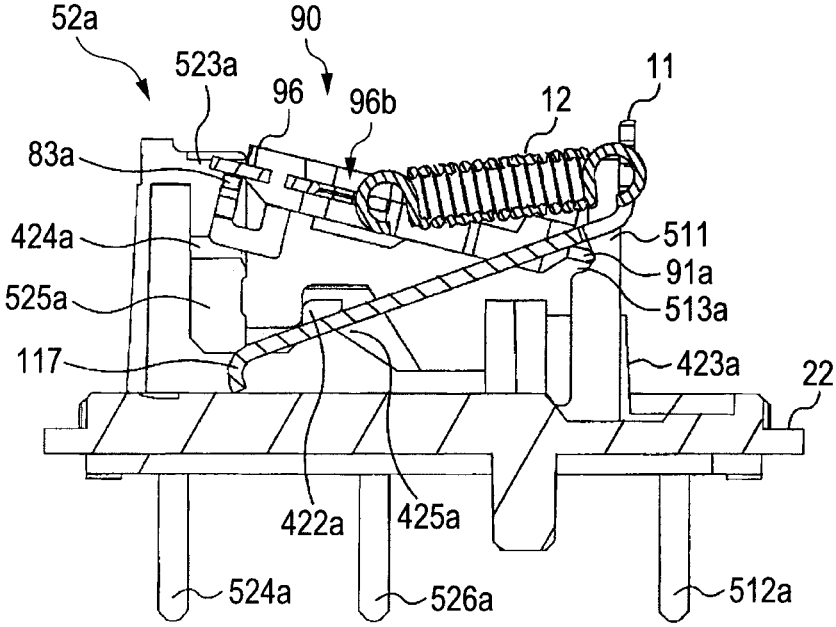

When separating a hand pushing the first driving body member 90 from the state shown in FIG. 26, the left side portion of the first driving body member 90 can be lifted up by the biasing force of the tensile spring 12. In this case, as shown in FIG. 27A, the first driving body member 90 is lifted up to the position where the contact pieces 10*a* and 10*b* provided on the upper surfaces of the connecting member 10 come into contact with the contact point portions 511*a* and 511*b* of the common contact points 51*a* and 51*b* and is stopped in the contact position. As shown in FIG. 27B, in the second driving body 11, the contact piece 117 is in contact with the lower surface of the lower case 22 to restrict a further rotation of the second driving body 11. In this manner, the rotation of the first driving body member 90 is restricted by the contact pieces 10*a* and 10*b* and the rotation of the second driving body 11 is restricted by the contact piece 117, whereby it is possible to maintain the first driving body member 90 and the second driving body 11 in the process of the assembling work in a stable state. At this time, the left side end portion of the first driving body member 90 is slightly extended upward.

When the first driving body member 90 enters the state shown in FIG. 27, the first driving body member 90 and the second driving body 11, on which the biasing force dragged to each other by the tensile spring 12 acts, are maintained rotatably to the fulcrum portions 92*a* and 92*b* coming into contact with the concave portions 513*a* and 513*b* and the fulcrum portions 115*a* and 115*b* coming into contact with the concave portions 425*a* and 425*b*. In the switch device 100 according to the second embodiment, the snap action mechanism 7 is constituted by the first driving body member 90, the second driving body 11, and the tensile spring 12 of the state of being assembled to the lower case 22 in this manner.

In this manner, in the method of assembling the snap action mechanism 7 included in the switch device 100 according to the second embodiment, after the second driving body 11 and the first driving body member 90 are mounted on the supporters 4*a* and 4*b* and the tensile spring 12 is attached to both, only by disposing the fulcrum portions 115*a* and 115*b* of the second driving body 11 in the concave portions 425*a* and 425*b* of the protruding pieces 422*a* and 422*b*, the first driving body member 90 and the second driving body 11 can be assembled in a predetermined position of the housing 2. Thus, it is possible to simply assemble the snap action mechanism 7 without requiring complicated work.

Figure 28:
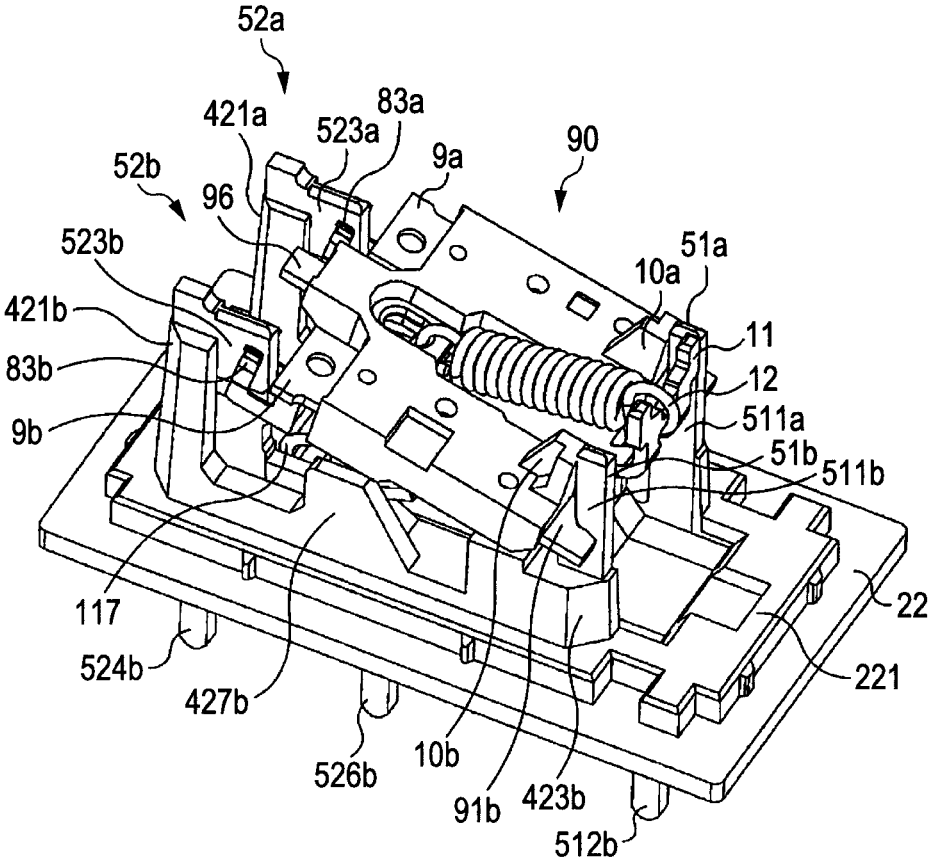
FIG. 28 is a perspective view of the lower case in which a snap action mechanism is assembled in the switch device according to the second embodiment.
Figure 29:
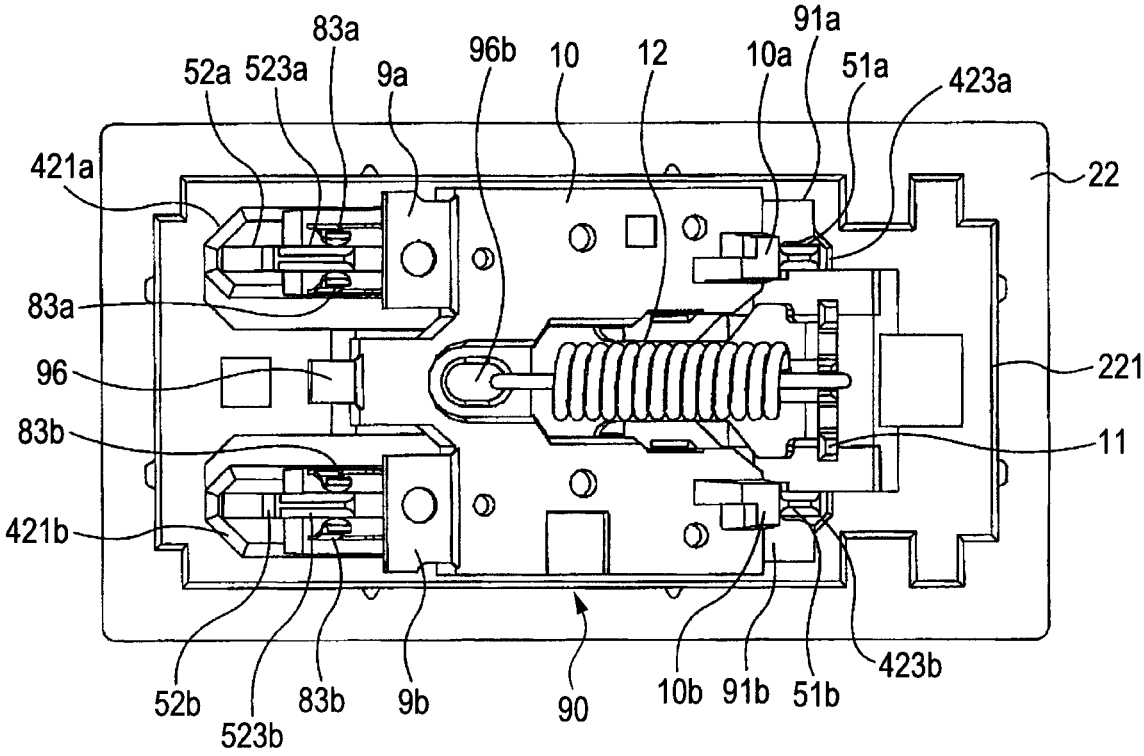
FIG. 29 is a plan view of the lower case in which a snap action mechanism is assembled in the switch device according to the second embodiment.
Figure 30A:
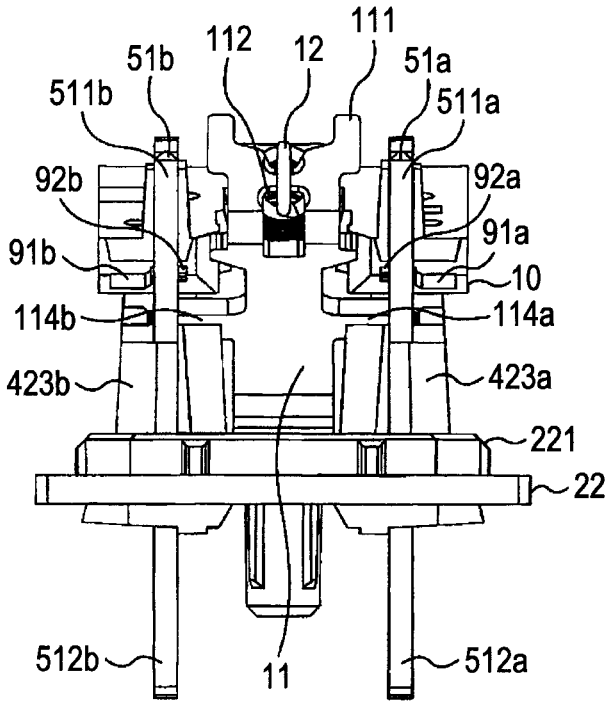
FIG. 30 is a side view of the lower case in which a snap action mechanism is assembled in the switch device according to the second embodiment.
Figure 30B:
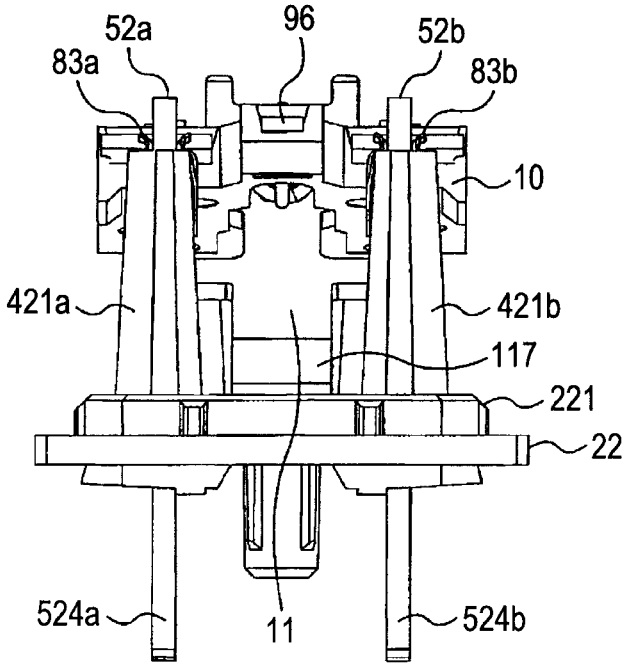

Herein, the configuration of the lower case 22, in which the snap action mechanism 7 is assembled in this manner, will be referenced to FIGS. 27 and 28 to 30. FIGS. 28 and 29 are a perspective view and a plan view of the lower case 22 in which the snap action mechanism 7 is assembled in the switch device 100 according to the second embodiment, respectively. FIG. 30 is a side view of the lower case 22 in which the snap action mechanism 7 is assembled in the switch device 100 according to the second embodiment. FIG. 30A shows a side surface when seen from a right side shown in FIG. 29, and FIG. 30B shows a side surface when seen from a left side shown in FIG. 29.

As shown in FIGS. 27 and 28, in the state of being assembled to the lower case 22, the first driving body member 90 is maintained in an upward state toward the left side shown in FIGS. 27 and 28, while the second driving body 11 is maintained in an upward state toward the right side shown in FIGS. 27 and 28. The movable contact points 8*a* and 8*b* disposed on the lower surface of the first driving body member 90 are extended to the left upside shown in FIGS. 27 and 28, and the contact point portions 83*a* and 83*b* are in sliding contact with the slide-contact portion 523*a* and 523*b* of the switch-over contact point 52*a* and 52*b*. The contact pieces 10*a* and 10*b* provided on the upper surface of the first driving body member 90 come into contact with the common contact points 51*a* and 51*b* to restrict the rotation of the first driving body member 90, and the contact piece 117 of the second driving body 11 comes into contact with the upper surface of the lower case 22 to restrict the rotation of the second driving body 11.

Furthermore, as shown in FIGS. 29 and 30, the fixed contact points 5*a* and 5*b* (the common contact points 51*a* and 51*b* and the switch-over contact points 52*a* and 52*b*) are provided in the lower case 22 side by side at a predetermined gap. The first driving body member 90 disposes the first driving bodies 9*a* and 9*b* in positions corresponding to the fixed contact points 5*a* and 5*b*, respectively, and disposes the movable contact points 8*a* and 8*b* in positions interposing the switch-over contact points 52*a* and 52*b* therebetween. Furthermore, the second driving body 11 is disposed so as to pass through the center portion in the lower side of the first driving body member 90, and is connected to the hole 96*b* provided in the reinforcing member 96 via the tensile spring 12.

Figure 31:
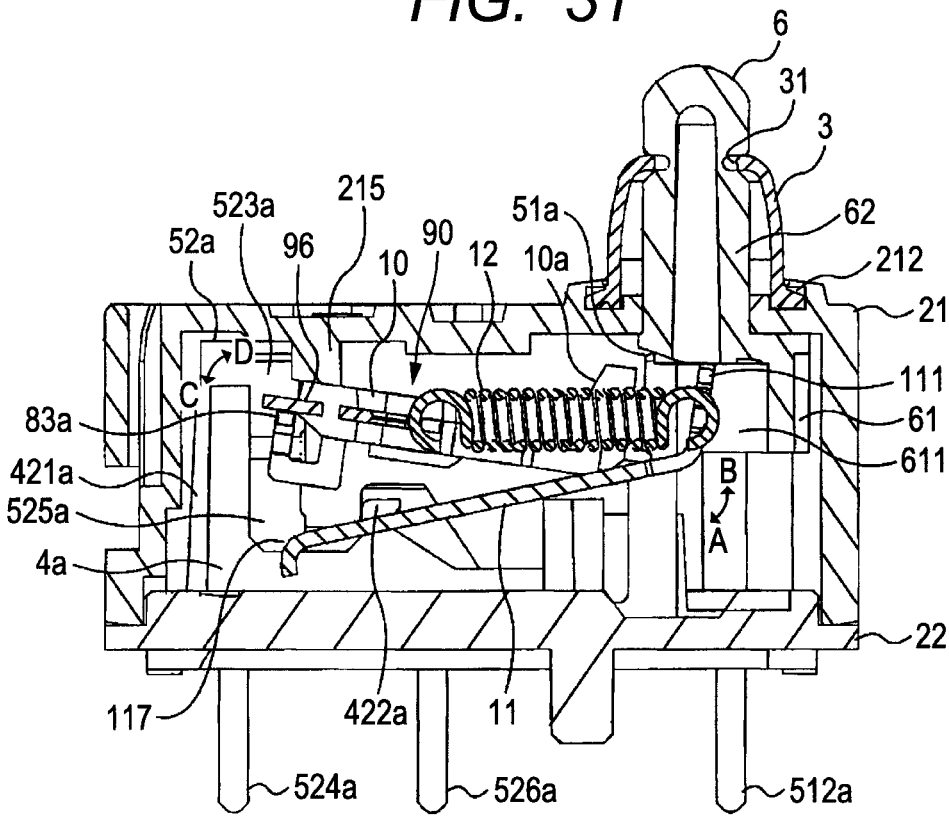
FIG. 31 is a side cross-sectional view for explaining an internal configuration of the switch device according to the second embodiment.

In the switch device 100 according to the second embodiment, with respect to the lower case 22 in which the snap action mechanism 7 is assembled in this manner, the upper case 21 is attached in a state in which the operation member 6 is disposed in the receiving member. Herein, the internal configuration of the switch device 100 according to the second embodiment will be described. FIG. 31 is a side cross-sectional view for explaining the internal configuration of the switch device 100 according to the second embodiment.

As shown in FIG. 31, the operation member 6 accommodates the pressing target portion 111 of the second driving body 11 by an accommodation portion 611 provided on the lower surface of a pressing portion 61, and is disposed in the receiving portion in the housing 2 in the state of inserting a shaft portion 62 into an opening 211. The cover 3, in which an outer edge portion provided in the lower end portion thereof is attached to a groove portion 212, is attached to the shaft portion 62 protruding from the opening portion 211. In addition, the upper end portion of the shaft portion 62 is protruded from the hole 31 of the cover 3.

Furthermore, in a predetermined position of an inner wall surface (a ceiling surface) of the upper case 21, similarly to the switch device 1 according to the first embodiment, a protruding wall 215 is provided. The protruding wall 215 is disposed on the upside of the connecting member 10 of the first driving body member 90, comes into contact with the upper surface (the upper surface of the connecting member 10) of the first driving body member 90 of the initial state, and functions as a stopper of the rotation of the first driving body member 90. In addition, in the switch device 100 according to the second embodiment, unlike the switch device 1 according to the first embodiment, the protruding walls 213*a* and 214*a* are not provided on the inner wall surface of the upper case 21, but they may be provided.

In the switch device 100 according to the second embodiment, when receiving the pressing operation by the operation member 6 disposed on the pressing target portion 111, it is operated similarly to the switch device 1 according to the first embodiment. That is, as the pressing target portion 111 is pushed downward, the second driving body 11 is rotated in an arrow A direction using the fulcrum portions 115*a* and 115*b* as the rotation fulcrum in resistance to the biasing force of the tensile spring 12. Meanwhile, when the pressing operation relative to the operation member 6 is released, the second driving body 11 is rotated in an arrow B direction using the fulcrum portions 115*a* and 115*b* as the rotation fulcrum depending on the biasing force of the tensile spring 12. In this case, the first driving body member 90 is rotated in arrows C and D directions using the fulcrum portions 92*a* and 92*b* as the rotation fulcrum depending on the rotation position of the second driving body 11.

Figure 32:
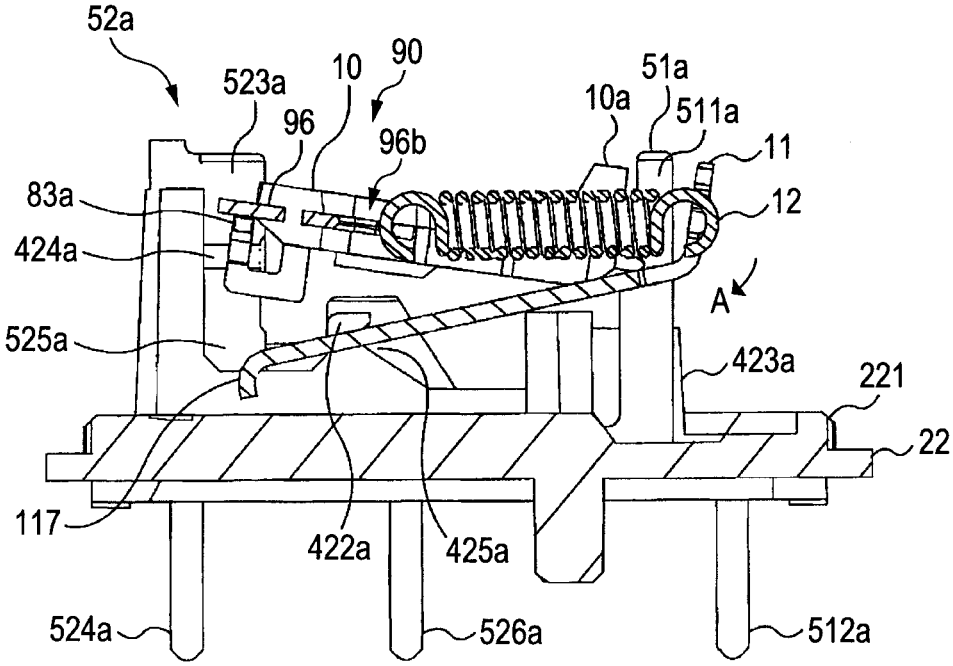
FIG. 32 is a side cross-sectional view for explaining a motion due to a pressing operation in the switch device according to the second embodiment.
Figure 33:
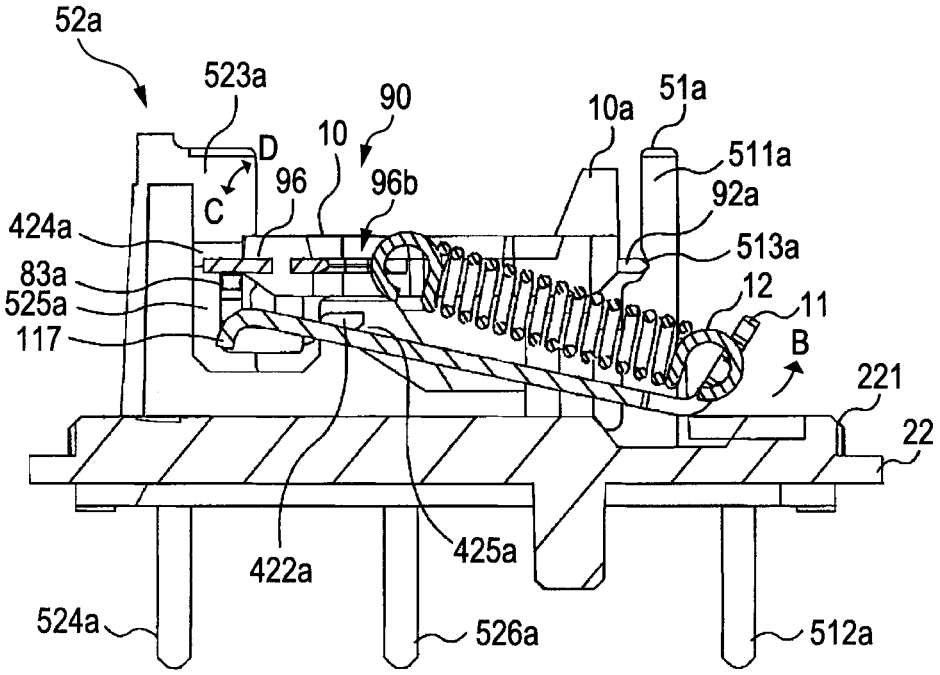
FIG. 33 is a side cross-sectional view for explaining a motion due to a pressing operation in the switch device according to the second embodiment.

Hereinafter, the motion accompanied by the pressing operation of the operation member 6 in the switch device 100 according to the second embodiment will be described. FIGS. 32 and 33 are side views for explaining the motion accompanied by the pressing operation in the switch device 100 according to the second embodiment. In addition, in FIGS. 32 and 33, for convenience of description, the upper case 21, the cover 3, and the operation member 6 are omitted.

In a state (an initial state) in which the pressing operation is not performed on the operation member 6, the switch device 100 is in the states shown in FIG. 32, the movable contact points 8*a* and 8*b* are extended to the left upside shown in FIG. 32, the contact point portions 83*a* and 83*b* are in sliding contact with each other with the slide-contact point portions 523*a* and 523*b* of the switch-over contact points 52*a* and 52*b* interposed therebetween. In this case, the circuit having the first switch-over contact points 521*a* and 521*b* as the normal close contact point and the common contact points 51*a* and 51*b* is in a connected state.

When the pressing operation is received by the operation member 6 and the pressing target portion 111 is pressed to the lower side, the second driving body 11 is rotated in an arrow A direction using the fulcrum portions 115*a* and 115*b* as the rotation fulcrum in resistance to the biasing force of the tensile spring 12. However, when the second driving body 11 is rotated up to a predetermined limitation position, the first driving body member 90 is stopped in an initial position (a position shown in FIG. 32). Thus, the contact point portions 83*a* and the 83*b* of the movable contact points 8*a* and 8*b* are still in sliding contact with the slide-contact portion 523*a* and 523*b*.

Moreover, when the second driving body 11 is rotated up to a predetermined limitation position, the direction of the biasing force of the tensile spring 12 acting on the first driving body member 90 and the second driving body 11 is reversed, the first driving body member 90 is dragged to the lower side, and as shown in FIG. 33, the first driving body member 90 is rotated in an arrow C direction using the fulcrum portions 92*a* and 92*b* as the rotation fulcrum in an instant. In this case, the contact point portions 83*a* and 83*b* of the movable contact points 8*a* and 8*b* pass through the insulation piece 424*b* and come into sliding contact with the slide-contact point portions 525*a* and 525*b*. As a result, the circuit having the second switch-over contact points 522*a* and 522*b* as the normal open contact point and the common contact points 51*a* and 51*b* is converted to the connected state. In this case, since the movable contact points 8*a* and 8*b* are provided in the first driving bodies 9*a* and 9*b* connected by the connecting member 10, the movable contact points 8*a* and 8*b* slide on the switch-over contact points 52*a* and 52*b* at substantially the same timing and slide on the slide-contact point portions 525*a* and 525*b*.

Meanwhile, when the pressing operation of the operation member 6 is released, the second driving body 11 is rotated in an arrow B direction using the fulcrum portions 115*a* and 115*b* as the rotation fulcrum depending on the biasing force of the tensile spring 12. However, until the second driving body 11 is rotated up to a predetermined limitation position, the first driving body member 90 is still stopped in a position shown in FIG. 33. Thus, the contact point portions 83*a* and 83*b* of the movable contact points 8*a* and 8*b* are in sliding contact with the slide-contact point portions 525*a* and 525*b*.

Moreover, when the second driving body 11 is rotated up to a predetermined limitation position, a direction of the biasing force of the tensile spring 12 acting on the first driving body member 90 and the second driving body 11 is reversed, the first driving body member 90 is dragged to the upside via the tensile spring 12, the first driving body member 90 is rotated in an arrow D direction using the fulcrum portions 92*a* and 92*b* as the rotation fulcrum in an instant, and returns to the initial position (see FIG. 32). In this case, the contact point portions 83*a* and 83*b* of the movable contact points 8*a* and 8*b* pass through the insulation piece 424*b* and are in sliding contact with the slide-contact point portions 523*a* and 523*b*. As a result, the circuit having the first switch-over contact points 521*a* and 521*b* as the normal close contact point and the common contact points 51*a* and 51*b* is converted to a connected state. Also, in this case, the movable contact points 8*a* and 8*b* slide on the switch-over contact points 52*a* and 52*b* at substantially the same timing and are brought into sliding contact with the slide-contact point portions 523*a* and 523*b*.

As described above, according to the switch device 100 according to the second embodiment, since the switch device 100 includes the snap action mechanism 7 driving the first driving body member 90 with the movable contact points 8*a* and 8*b* provided therein, when the operation member 6 is pressed to a predetermined limitation position, it is possible to drive the movable contact points 8*a* and 8*b* provided in the first driving bodies 9*a* and 9*b*, which are integrally connected to each other, in an instant, by the biasing force of the tensile spring 12. Thus, even when a plurality of circuits is synchronized and switched, it is possible to reduce the irregularity of the synchronization timing of the circuit switch-over.

In addition, the invention is not limited to the above embodiments, but can be variously modified and embodied. In the above embodiments, the size, the shape, or the like shown in the accompanying drawings is not limited thereto, but can be suitably modified within a scope of exhibiting the effect of the invention. In addition, they can be suitably modified unless departing from the scope of the invention.

For example, in the above-mentioned embodiments, although a case has been described where the first driving body member 90 includes two first driving bodies 9*a* and 9*b*, the number of the first driving body 9 is not limited thereto, but three or more first driving bodies 9 may be included depending on the number of the circuit becoming the switch-over target. In addition, in this case, there is a need to include the movable contact point 8 of the number depending on the number of the first driving body 9. Even when the number of the first driving body 9 is increased, the same effect as the above-mentioned embodiments can be obtained.

Furthermore, in the above-mentioned embodiments, although a case has been described where the movable contact points 8*a* and 8*b* are attached to the first driving bodies 9*a* and 9*b*, the configurations of the movable contact points 8*a* and 8*b* are not limited thereto, but can be suitably changed. For example, the movable contact points 8*a* and 8*b* may be set in the first driving bodies 9*a* and 9*b*. As above, even when the movable contact points 8*a* and 8*b* are provided in the first driving bodies 9*a* and 9*b*, the same effect can be obtained.

Figure 18:
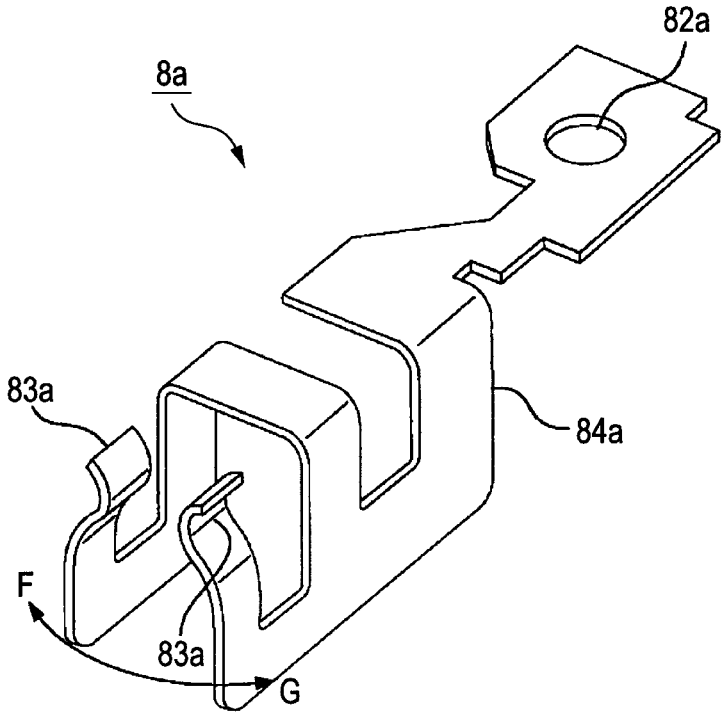
FIG. 18 is a perspective view that shows a modified example of a movable contact point included in the switch device according to the first embodiment.

In addition, in the above-mentioned embodiments, as shown in FIG. 4, a case has been described where the contact point portions 83*a* and 83*b* are provided on the fixing surfaces of the movable contact points 8*a* and 8*b* fixed to the first driving bodies 9*a* and 9*b*. However, the configurations of the movable contact points 8*a* and 8*b* fixed to the first driving bodies 9*a* and 9*b* are not limited thereto, but can be suitably changed. For example, as shown in FIG. 18, a side surface portion 84*a* having an L shape when seen from the side thereof, which is extended from an end of the fixing surface of the movable contact point 8*a* fixed to the first driving body 9*a*, may be provided, and a lower end portion of one U-shaped piece of a pair of U-shaped pieces when seen from the side thereof may be connected to the front end of the side surface portion 84*a* to provide the contact point portions 83*a*. In this case, the movable contact point 8*a* is fixed to the first driving body 9*a* in a so-called cantilever beam shape, and the contact point portion 8*a* can slightly roll in arrows F and G directions shown in FIG. 18. As a result, even if the positions of the switch-over contact points 52*a* adjacent to each other are deviated, the position of the contact point portion 83*a* can be adjusted depending on the difference. Thus, it is possible to reliably sliding contact with the slide-contact point portions 523*a* and 525*a* provided in the switch-over contact point 52*a* interposed therebetween. In this manner, the movable contact point including the above-mentioned embodiments comes into sliding contact with the switch-over contact on both sides, but one surface sliding contact may be adopted in the invention. Furthermore, as a shape coping with the position deviation of the switch-over contact points 52*a* adjacent to each other, when the movable contact points 8*a* and 8*b* are attached to the first driving bodies 9*a* and 9*b*, the mobility may be adopted. In this case, since the position of the contact point portion 83*a* can be adjusted corresponding to the position deviation of the switch-over contact points 52*a* adjacent to each other without requiring a special configuration, it is possible to reliably sliding contact with the slide-contact point portions 523*a* and 525*a* provided in the switch-over contact point 52*a* interposed therebetween.

In addition, in the above-mentioned embodiment, the method of assembling the snap action mechanism 7 having the first driving body member 90 and the second driving body 11 which is constituted by connecting the first driving bodies 9*a* and 9*b* by the connecting member 10 has been described. However, the method of assembling the snap action mechanism 7 according to the invention is not limited to the snap action mechanism 7 having such components but can be suitably changed. For example, the method can also be applied to the snap action mechanism 7 having a single first driving body 9 and a single second driving body 11 or the snap action mechanism 7 having the movable contact point other than a clip shape. Even when the method is applied to the snap action mechanism 7 having the single first driving body 9 and the single second driving body 11, similarly to the above-mentioned embodiments, the snap action mechanism 7 can be simply assembled without requiring complicated work.

In addition, in the above-mentioned embodiments, a case has been described where the fixed contact point 5 having the common contact points 51*a* and 51*b*, the first switch-over contact points 521*a* and 521*b* as the normal close contact point, and the second switch-over contact points 522*a* and 522*b* as the normal open contact point is included, but the configurations of the fixed contact points 5*a* and 5*b* are not limited thereto, but can be suitably changed. For example, a configuration may be adopted which does not include the common contact point, and, upon being operated by the normal open, connects two contact points of the fixed contact points 5*a* and 5*b* to each other by the contact point portions 83*a* and 83*b* of the movable contact points 8*a* and 8*b*.

What is claimed is:

1. A switch device comprising:

a housing having a receiving portion;

an operation member that receives a pressing operation;

a plurality of fixed contact points provided in the receiving portion side by side at predetermined intervals;

a plurality of movable contact points having contact point portions that come into sliding contact with the fixed contact points; and a snap action mechanism that drives the movable contact points when the operation member is pressed to a predetermined position, wherein the snap action mechanism includes:

a first driving body member having:

a plurality of first driving bodies each of which has a movable contact point provided at one end side thereof and a fulcrum portion constituting a rotation fulcrum provided at the other end side thereof; and a connecting member configured to integrally connect the plurality of first driving bodies to each other;

a second driving body which is formed with a pressing target portion to be pressed by the operation member at one end side thereof and is formed with a fulcrum portion constituting a rotation fulcrum at the other end side thereof; and a tensile spring which is attached to a part of the first driving body member and a part of the second driving body at both ends.

2. The switch device according to claim 1, wherein a reinforcing member is embedded in the connecting member in a partially exposed state, and one end of the tensile spring is attached to the exposed portion of the reinforcing member.

3. The switch device according to claim 2, wherein each of the first driving bodies includes a conductor plate formed with the fulcrum portion, and the movable contact point attached to the conductor plate, in which an attachment portion of the movable contact point relative to the conductor plate is embedded in the connecting member.

4. The switch device according to claim 3,
wherein the reinforcing member is constituted by a part of the conductor plate.

5. The switch device according to claim 3,
wherein the conductor plate and the movable contact point are formed of separate materials, and a rigidity of a material of the conductor plate is higher than that of a material of the movable contact point.

6. The switch device according to claim 1,
wherein a pair of pieces of the movable contact points are connected in the first driving bodies side, the contact point portions are respectively provided in a front end in a side opposite to the first driving bodies, and a portion in which the contact point portions of the pair of pieces of the movable contact points are provided, is disposed oppositely so as to extend to an upper side.

7. The switch device according to claim 1,
wherein the tensile spring is attached to a part of the first driving body member and a part of the second driving body in a position between the adjacent first driving bodies.

8. The switch device according to claim 1, further comprising:
an engagement mechanism provided in a part of the first driving body member and a part of the second driving body, the engagement mechanism engages depending on the biasing force of the tensile spring and integrates the first driving body member and the second driving body.

9. The switch device according to claim 1, further comprising:
a protruding wall provided on an inner wall surface of the housing on a side of a direction to which a tensile load of the tensile spring is applied with respect to a common contact point of the plurality of fixed contact points provided in the receiving portion, the protruding wall being adjacent to and facing a front end of the common contact point.

10. The switch device according to claim 1,
wherein the fixed contact points are disposed in a position farther than a disposition position of the fulcrum portion of the second driving body from a disposition position of the fulcrum portion of the first driving bodies.

11. The switch device according to claim 1,
wherein a lower surface of the connecting member of the first driving body member comes into contact with a supporter so as to restrict a rotation of the first driving body member in a lower direction due to a spring load of the tensile spring.

12. The switch device according to claim 1,
wherein an upper surface of the connecting member of the first driving body member comes into contact with the housing so as to restrict a rotation of the first driving body member in the upper direction due to a spring load of the tensile spring.

13. The switch device according to claim 1,
wherein the second driving body is provided with, a mounting portion capable of being mounted on a support portion provided in the housing during assembly, and the fulcrum portion is formed in an end portion of a part of the mounting portion.

14. The switch device according to claim 13, further comprising:
an allowance portion provided in a switch-over contact point of the fixed contact points, the allowance portion allowing a disposition of the fulcrum portion of the second driving body during assembly thereof.

15. The switch device according to claim 13,
wherein the mounting portion includes:
a first mounting portion provided on a common contact point side of the fixed contact points; and
a second mounting portion provided on a switch-over contact point side of the fixed contact points,
and wherein the second mounting portion is longer than the first mounting portion in a direction from the common contact point to the switch-over contact point.

16. The switch device according to claim 13, further comprising:
a first rotation restriction portion provided in the first driving body member, the first rotation restriction portion being configured to come into contact with a common contact point of the plurality of fixed contact points so as to restrict a rotation due to a spring load of the tensile spring during assembly thereof; and
a second rotation restriction portion provided in the second driving body, the second rotation restriction portion being configured to come into contact with the housing so as to restrict a rotation due to the spring load of the tensile spring during assembly thereof.

17. A method of assembling a snap action mechanism in a housing having a fixed contact point and a support portion, the snap action mechanism including a plurality of first driving bodies and a second driving body, the method comprising:
mounting the second driving body onto the housing such that a mounting portion of the second driving body is placed on an upper surface of the support portion at a predetermined position relative to the fixed contact point;
mounting the plurality of first driving bodies on the second driving body;
attaching a tensile spring between a part of the first driving bodies and a part of the second driving body;
pushing the second driving body in a first direction against a biasing force of the tensile spring such that the mounting portion slides to one side of the support portion; and
pushing down a fulcrum portion of the second driving body, the fulcrum portion being provided on an end portion of the second driving body which is located on another side of the support portion, such that the fulcrum portion is disposed in a concave portion of the housing, thereby assembling the second driving body in a predetermined position of the housing by a spring load of the tensile spring.

18. The method according to claim 17,
wherein a part of the plurality of first driving bodies come into contact with a common contact point of the fixed contact points so as to restrict a rotation due to the spring load of the tensile spring, and a part of the second driving body comes into contact with the housing so as to restrict a rotation due to the spring load of the tensile spring.

19. The method according to claim 17,
wherein the tensile spring is attached in a state in which the first driving bodies are mounted in parallel to the second driving body.

20. The method according to claim 17, wherein the support potion includes a first support portion and a second support portion formed as a protruding pieces.

* * * * *